United States Patent [19]

Lin et al.

[11] Patent Number: 4,685,135

[45] Date of Patent: Aug. 4, 1987

[54] TEXT-TO-SPEECH SYNTHESIS SYSTEM

[75] Inventors: Kun-Shan Lin; Kathleen M. Goudie; Gene A. Frantz, all of Lubbock, Tex.

[73] Assignee: Texas Instruments Incorporated, Dallas, Tex.

[21] Appl. No.: 240,694

[22] Filed: Mar. 5, 1981

[51] Int. Cl.[4] ..... G10L 5/00

[52] U.S. Cl. ..... 381/52; 382/1; 382/40

[58] Field of Search ..... 179/1 SF, 1 SM, 1 SD; 364/513, 513.5; 340/146.3 WD; 381/51-53

[56] References Cited

U.S. PATENT DOCUMENTS

| | | | |
|---|---|---|---|
| 3,632,887 | 1/1972 | Leipp | 179/1 SF |
| 3,704,345 | 11/1972 | Coker et al. | 179/1 SM |
| 4,130,730 | 12/1978 | Ostrowski | 179/1 SM |
| 4,209,836 | 6/1980 | Wiggins et al. | 179/1 SC |
| 4,278,838 | 7/1981 | Antonov | 179/1 SM |
| 4,337,375 | 6/1982 | Freeman | 179/1 SA |

OTHER PUBLICATIONS

Miotti et al, "Unlimited Vocabulary Voice", Int'l Conf. on Communications, Jun. 1979.

Elovitz et al, "Letter to Sound Rules . . . ", IEEE Trans. on Acoustics, Dec. 1976, pp. 446–455.

*Primary Examiner*—E. S. Matt Kemeny

*Attorney, Agent, or Firm*—William E. Hiller; N. Rhys Merrett; Melvin Sharp

[57] ABSTRACT

A text-to-speech synthesis system receives digital code representative of characters from a local or remote source, and converts those character codes into speech. A set of allophone rules is contained in a memory and each incoming character set is matched with the proper character set to describe the sound of that particular character set. A microcontroller is dedicated to the comparison procedure which provides allophonic code when a match is made. The allophonic code is provided to a speech producing system which has a system microcontroller for controlling the retrieval, from a read-only memory, of digital signals representative of the individual allophone parameters. The addresses at which such allophone parameters are located are directly related to the allophonic code. A dedicated microcontroller concatenates the digital signals representative of the allophone parameters, including code indicating stress and intonation patterns for the allophones. An LPC speech synthesizer receives the digital signals and provides analog signals corresponding thereto to a loud speaker to produce speech-like sounds with stress and intonation.

27 Claims, 40 Drawing Figures

TEXT-TO-ALLOPHONE RULES

Legends

| | |
|---|---|
| b | blank |
| # | 1 or more vowels (A E I O U Y) |
| . | voiced consonant (B D V G J L M N R W Y Z) |
| % | a suffix (ER E ES ED ING ELY) |
| & | a sibilant (S C G Z X J CH SH) |
| @ | a consonant influencing the sound of the following "U" (T S R D L Z N J TH CH SH) |
| ^ | one consonant (B C D F G H J K L M N P Q R S T V W X Y Z) |
| + | a front vowel (E I Y) |
| : | zero or more consonants |
| * | one or more consonants |
| < | labial consonanct (B P W) |

Fig. 2a

*Fig. 2b*

A-rules

| | | |
|---|---|---|
| [A]b | = /UH1/ | as in 'A' |
| b[ARE]b | = /AR3/ | as in 'ARE' |
| b[AR]D | = /UH1 R/ | as in 'AROUND' |
| [ARE]b | = /EHR3/ | as in 'CARE' |
| [ARI]# | = /EHR2 E1/ | as in 'VARIOUS' |
| [AR]# | = /EHR2/ | as in 'BARON' |
| b^[AS]Eb | = /EI2 SS/ | as in 'CASE' |
| b [AS]# | = /E12 S/ | as in 'BASIS' |
| [A]WA | = /UH1/ | as in 'AWAY' |
| [AW]b | = /AW3/ | as in 'SAW' |
| [AW] | = /AW3/ | as in 'LAWN' |
| [AW] | = /AW2/ | as in 'AWFUL' |
| F[A]TH | = /AH2/ | as in 'FATHER' |
| b:[ANY] | = /EH2 N Y2/ | as in 'ANY' |
| #:[AN]Y | = /UH1N N/ | as in 'COMPANY' |
| N[A]TIONAL | = /AE2 | as in 'NATIONAL' |
| R[A]TIONAL | = /AE2/ | as in 'RATIONAL' |
| [A]^+# | = /EI2/ | as in 'AMIABLE' |
| L[ALLOW] | = /UH1 L AU3/ | as in 'ALLOWING' |
| #:[ALLY] | = /LL Y2/ | as in 'FINALLY' |
| L[AL]READ | = /AW1 L-/ | as in 'ALREADY' |
| b[AL]# | = /UH1 L/ | as in 'ALIVE' |
| L[A] R | = /UH1/ | as in 'AGREEMENT' |
| #:[AG]E | = /I1 JJ/ | as in 'BANDAGE' |
| L:[AT]EMENT | = /E12 TH-/ | as in 'STATEMENT' |
| [AY]EDb | = /E13/ | as in 'STAYED' |
| [AY]:# | = /E12/ | as in 'MAYBE' |
| [AY] | = /E13/ | as in 'SAY' |
| [A]X | = /AE2/ | as in 'WAXES' |
| [A]Yb | = /EI3/ | as in 'BABY' |
| [A]^Yb | = /EI2/ | as in 'RACY' |
| bN[A]TUR% | = /E12/ | as in 'NATURE' |
| [A]TURE:b | = /UH1/ | as in 'TEMPERATURE' |
| #:F[A]C% | = /UH1/ | as in 'SURFACE' |
| V[A]T% | = /UH1/ | as in 'PRIVATE' |
| N[A]T% | = /UH1/ | as in 'SENATE' |
| [A]TELY | = /UH1/ | as in 'APPROXIMATELY' |
| [A]% | = /EI3/ | as in 'AGE' |
| [A]^% | = /EI2/ | as in 'RACES' |
| BEG[A]N | = /AE3/ | as in 'BEGAN' |
| #*[A]Nb | = /UH1N/ | as in 'HUMAN |
| #*#[A]Nb | = /UH1N/ | as in 'CHRISTIAN' |
| b[A]N | = /AE2/ | as in 'ANIMAL' |
| b[A] # | = /UH1/ | as in 'AGAINST' |
| b[A]N | = /AE2/ | as in 'AND' |
| #:L[A]ND | = /UH1N/ | as in 'ISLAND' |
| [A] + :# | = /AE2/ | as in 'INANIMATE' |
| [ARR] | = /AE2 R/ | as in 'CARRIAGE' |
| b*[AR]b | = /AR3/ | as in 'CAR' |
| [AR]b | = /ER1/ | as in 'POLAR' |
| [AR] | = /AR3/ | as in 'CARD' |
| [AR]^ | = /AR2/ | as in 'CART' |
| [AIR] | = /EHR3/ | as in 'HAIR' |
| b:O*[AI]NT:b | = /E12/ | as in 'COMPLAINTS' |
| b:O*[AI]N:b | = /E13/ | as in 'CONTAINS' |
| b:O*[AI]NEDb | = /E13/ | as in 'CONTAINED' |
| L:O*[AU]N | = /E12/ | as in 'CONTAINER' |
| bRE*[AI]NT: | = /E12/ | as in 'RESTRAINTS' |
| bRE*[AI]N:b | = /E13/ | as in 'REMAINS' |

*Fig. 2c*

```
bRE*[AI]NEDb= /E13/                 as in 'REMAINED'
bRE*[AI]N:% = /E12/                 as in 'REMAINDER'
T[AI]NMENT  = /E12/                 as in 'ENTERTAINMENT"
#*[AI]N     = /EH1N/                as in 'CAPTAIN'
[AI].:b     = /E13/                 as in 'VAIN'
[AI].       = /EI3/                 as in 'VAIN'
[AI]^       = /EI2/                 as in 'WAIST'
:[ATO]b     = /EI2 TH- OW2/         as in 'POTATO'
:[ATO]%     = /EI2 TH- OW2/         as in 'TOMATOES'
L[AUGH]     = /AE2 F/               as in 'LAUGHING'
[AU].       = /AW3/                 as in 'FAUN'
[AU]        = /AW2/                 as in 'ASTRONAUT'
#:[AL]b     = /LL/                  as in 'TOTAL'
#:[ALS]b    = /LL ZZ/               as in 'TOTALS'
[ALK]       = /AW2 KH-/             as in 'WALK'
[AL]Fb      = /AE2/                 as in 'CALF'
[AL].:b     = /AW3 L-/              as in 'BALD'
[AL]^       = /AW2 LL/              as in 'FALSE'
b:[ABLE]    = /EI2 B LL/            as in 'CABLE'
[ABLE]      = /UH1 B LL/            as in 'USABLE'
[AB]LY      = /UH1 B/               as in 'RELIABLY'
[ANGE]b     = /EI3 N JJ/            as in 'STRANGE'
[ANG]+      = /EI2 N J/             as in 'ANGEL'
#:[ANT]b    = /EH1N NN TH-/         as in 'IMPORTANT'
W[A]N.:b    = /AH3/                 as in 'WAND'
W[A]Nb      = /AH3/                 as in 'SWAN'
W[A]N       = /AH3/                 as in 'WANT'
T[AK]E      = /EI2 KH-/             as in 'TAKE'
[A]LOR      = /AE2/                 as in 'CALORIE:
[A] OR      = /E12/                 as in 'VAPOR'
[A].        = /AE3/                 as in 'BAD'
[A]         = /AE2/                 as in 'BAT'
```

B-rules

```
b[B]b       = /B E3/                as in 'B'
b[BE]^W#    = /B I1/                as in 'BETWEEN'
b[BE]^#     = /B I1/                as in 'BEGIN'
[BEE]N      = /B I3/                as in 'BEEN'
[BEING]     = /B E3 I1N NG2/        as in 'BEING'
b[BUS]#     = /B 12 2/              as in 'MAYBE'
b[BOTH]b    = /B OW2 THF-/          as in 'BOTH'
[BOW]       = /B OW3/               as in 'BOW'
MAY[BE]     = /B Y2/                as in 'BUSY'
[BEAUT]     = /B Y U2 TH-/          as in 'BEAUTY'
B[B]        = //                    as in 'RUBBING'
[B]T        = / /                   as in 'DEBT'
[B]b        = /BB/                  as in 'LAB'
[B]         = /B/                   as in 'BUY'
```

C-rules

```
b[C]b       = /S E3/                as in 'CDC'
b[CH]^      = /KH2/                 as in 'CHROME'
^E[CH]      = /KH2/                 as in 'MECHANIC'
[CH]        = /CH/                  as in 'ITCH'
[COM]%      = /KH2 UH3 MM/          as in 'COME'
[COST]      = /KH2 AW2 SS TH-/      as in 'COST'
[C]R        = /KH2/                 as in 'CROWS'
bS[CI]#     = /S AI2/               as in 'SCIENCE'
[CI]A       = /SH/                  as in 'TECHNICIAN'
```

*Fig. 2d*

```
[CI]O      = /SH/              as in 'CONSCIOUS'
[CI]EN     = /SH/              as in 'ANCIENT'
[C]Eb      = /SS/              as in 'RACE'
[C]C+      = /K2/              as in 'ACCENT '
[C]C       = / /               as in 'RACCOON'
X[C]       = / /               as in 'EXCEPT'
[C]+       = /S/               as in 'SINCERE'
[CK]       = /KH-/             as in 'TACK'
bS[C]A     = /K2/              as in 'SCALE'
[C]A +     = /KH/              as in 'CALIBER'
[C]AL      = /KH2/             as in 'LOCAL'
[C]O:      = /KH2/             as in 'COST'
[C]U       = /KH2/             as in 'CURSE'
[C]T       = /K2/              as in 'ACT'
[C]S       = /K2/              as in 'TICS'
[C]Q       = / /               as in 'ACQUIT'
[C]        = /KH-/             as in 'PUBLIC'
[C]        = /KH/              as in 'CUE'
```

D-rules

```
b[D]b      = /D E3/            as in 'DDT'
#:[DED]b   = /D Y1 DD/         as in 'DIVIDED'
.E[D]b     = /DD/              as in 'BRIBED'
#*E[D]b    = /TH-/             as in 'WISHED'
b[DE]^:#   = /D I1/            as in 'DECIDE'
[DIREC]    = /D I1 R EH2 K2/   as in 'DIRECT'
#[DG]E     = /JJ/              as in 'BUDGE'
b[DO]b     = /D U3/            as in 'DO'
b[DOES]    = /D UH2 ZZ/        as in 'DOES'
b[DO]NE    = /D UH3/           as in 'DONE'
b[DOING]   = /D U2 I1 NG2/     as in 'DOING'
E[OU]CA    = /J U1/            as in 'EDUCATION'
[DU]A      = /J U1/            as in 'INDIVIDUAL'
[DEAR]L    = /D EER2/          as in 'DEARLY'
[D]D       = //                as in 'PUDDING'
#:[D]Eb    = /DD/              as in 'RIDE'
[D]b       = /DD/              as in 'BID'
[D]        = /D/               as in 'DARE'
```

E-rules

```
Y[E]b      = //                as in 'DYE'
#:[E]b     = //                as in 'LIKE'
'*[E]b     = //                as in 'THEY'RE'
Y^[E]b     = //                as in 'TYPE'
b:[E]b     = /E3/              as in 'HE' or 'SHE'
#[ED]b     = /DD/              as in 'TIED'
#:DR[E]D   = /Y1/              as in 'HUNDRED'
#:[E]Db    = //                as in 'LIKED'
#:[EL]b    = /LL/              as in 'SHOVEL'
[EVERT]    = /EH2 V R Y2/      as in 'EVERYONE'
#:[ER]N    = /ER1N/            as in 'GOVERN'
[EV]ER     = /EH2 V/           as in 'EVER'
b[EYE]     = /AI3/             as in 'EYE'
[ER]Eb     = /EER3/            as in 'MERE'
[ER]ELYb   = /EER2/            as in 'MERELY'
[ERI]#     = /EER2 E1/         as in 'SERIOUS'
[ERI]      = /EHR2 I1/         as in 'MERIT'
#*[ENED]   = /EH1N NN DD/      as in 'HAPPENED'
```

*Fig. 2e*

```
#:[ER]#      = /ER1/                  as in 'COVERED'
#:[ER]b      = /ER1/                  as in 'EVER'
#:[ER]Sb     = /ER1/                  as in 'FEVERS'
[ER]#        = /EHR2/                 as in 'HERON'
[ER]         = /ER3/                  as in 'HER'
[ERR]b       = /EHR3/                 as in 'ERR'
[ERR]        = /EHR2/                 as in 'BERRY'
[ER].        = /ER3/                  as in 'HERD'
[ER]:        = /ER2/                  as in 'FERTILE'
b[EVEN]b     = /E2 V Y1 NN/           as in 'EVEN'
b[EVEN]T     = /E1 V EH2 N/           as in 'EVENTUAL'
b[EVEN]      = /E2 V Y1 N/            as in 'EVENLY'
#:[E]W       = //                     as in 'ELSEWHERE'
@[EW]        = /U3/                   as in 'NEW'
[EW]         = /Y U3/                 as in 'FEW'
COLL[E]GE    = /EH1/                  as in 'COLLEGES'
[E] %        = /E2/                   as in 'METES'
[E]O         = /E2/                   as in 'NEON'
[E]QUAL:b    = /E2/                   as in 'EQUALS'
[E]Q         = /E1/                   as in 'EQUALITY'
#:%[ES]b     = /Y1 ZZ/                as in 'ROSES'
#:[E]Sb      = //                     as in 'LIKES'
#:[ELY]b     = /L Y2/                 as in 'LIVELY'
b[ELE]VE     = /EH1 L EH2/            as in 'ELEVEN'
b[ELE]C      = /EH1 L EH2/            as in 'ELECTRIC'
b[EKE]N      = /EH2 LL EH1N/          as in 'ELEMENT'
b[ELE]       = /EH] LL EH1/           as in 'ELEPHANT'
b[E] #       = /EH1/                  as in 'ECONOMIC;
bC[EMENT]    = /Y1 M EH2 NN TH-/      as in 'CEMENT'
#:[EMENT]    = /M Y1 N TH-/           as in 'BASEMENT'
#M[E]NTARY   = /EH2/                  as in 'ELEMENTARY'
#M[E]NTAL    = /EH]/                  as in 'ELEMENTAL'
#:M[E]NT     = /EH1N/                 as in 'ELEMENT'
#:[ENT]b     = /EH1 NN TH-/           as in 'CONTENT'
#:[ENT]Sb    = /EH1 NN TH-/           as in 'CONTENTS'
#:[E]NCEb    = /EH1N/                 as in 'DIFFERENCE'
#:[E]NC%     = /EH1N/                 as in 'DIFFERENCES'
[EFUL]       = /F LL/                 as in 'FATEFUL'
[EE]b        = /E3/                   as in 'SEE'
[EEL]        = /EELL/                 as in 'FEEL'
@[EIL]       = /EELL/                 as in 'CEILING'
[EER]        = /EER3/                 as in 'DEER'
[EE].        = /E3/                   as in 'SEED'
[EE]         = /E2/                   as in 'SEEK', 'SEEING'
[EARN]b      = /ER3 NN/               as in 'LEARN'
[EARN]S      = /ER3 NN/               as in 'LEARNS'
[EARN]ED     = /ER3 NN/               as in 'LEARNED'
[EARN]       = /ER3 N/                as in 'EARNEST'
[EAR]L       = /ER3/                  as in 'PEARL'
b[EAR]Sb     = /EER3/                 as in 'EARS'
:[EAR]^H     = /ER2/                  as in 'EARTH'
b<[EAR]      = /EHR3/                 as in 'WEAR'
b:[EAR]      = /EER3/                 as in 'HEAR'
[EAD]        = /EH3 DD/               as in 'BREAD'
R[EA]D       = /EH2/                  as in 'ALREADY'
H[EA]D:b     = /EH3/                  as in 'HEADS'
H[EA]D       = /EH2/                  as in 'HEADING'
D[EA]Db      = /EH3/                  as in 'DEAD'
D[EA]D       = /EH2/                  as in 'DEADLY'
T[EA]Db      = EH3/                   as in 'INSTEAD'
T[EA]D       = /EH2/                  as in 'STEADY'
[EA]DY       = /EH2/                  as in 'READY'
```

*Fig. 2f*

```
[GU]I^%     = /G2/                  as in 'BEGUILE'
[GU]IT      = /G1/                  as in 'GUITAR'
[GUE]b      = /GG/                  as in 'VAGUE'
[GU]#       = /G2/                  as in 'GUAGE'
SU[GGES]    = /G1 J EH2 S/          as in 'SUGGESTION'
[GG]+       = /G2/                  as in 'BIGGER'
[G]G        = / /                   as in 'DOGGONE'
bB#[G]+     = /G1/                  as in 'BEGIN'
bB#[G]:#    = /G2/                  as in 'BEGONE'
[GEOR]G+    = /J OR3/               as in 'GEORGE'
[G]+        = /J/                   as in 'GIN'
[GREAT]     = /G2 R EI2 TH-/        as in 'GREAT'
A[GAIN]     = /G1 EH2 NN/           as in 'AGAIN'
#[GH]       = //                    as in 'HIGH'
[G]^#       = /G2/                  as in 'GRAY'
:#:[G]b     = /GG/                  as in 'BERG'
b[GO]NEb    = /G] AW3/              as in 'GONE'
b[G]N       = / /                   as in 'GNOSTIC'
[G]O        = /G2/                  as in 'GO'
[G]         = /G1/                  as in 'GAVE'
```

H-rules

```
b[H]b       = /EI2 CH/              as in 'H'
b[HAV]      = /HUH AE3 VV/          as in 'HAVE'
b[HEAR]T    = /HUH AR2/             as in 'HEART'
b[HEAR]D    = /HUH ER3/             as in 'HEARD'
[HEARS]%    = /HUH ER3 S/           as in 'REHEARSING'
b[HOUR]     = /AU3 ER1/             as in 'HOUR'
[HOW]       = /HUH AU3/             as in 'HOW'
b[HUM]#     = /HI Y U2 M/           as in 'HUMAN'
^[HIN]#     = /HUH AI2 N/           as in 'RHINE'
X[H]        = / /                   as in 'EXHAUST'
[H]INDb     = /HUH/                 as in 'BEHIND'
[H]+        = /HI/                  as in 'HE'
[H]O^       = /HO/                  as in 'HOLE'
[H]#        = /HUH/                 as in 'HUM'
[H]         = //                    as in '???'
```

I-rules

```
b[I]M*#     = /I1N/                 as in 'IMMEDIATE'
b[IN]:#     = /I1N N/               as in 'INCONVENIENT'
b*[I]NGb    = /I3/                  as in 'SING'
[ING]*#     = /ING2 G2/             as in 'SINGLE'
[ING]b      = /I1N NG2/             as in 'WARNING'
b[IN]       = /I2 N/                as in 'INSTEAD'
b:[I]b      = /AI3/                 as in 'I'
BUS[I]NE    = / /                   as in 'BUSINESS'
:[IN]Eb     = /AI3 NN/              as in 'WINE'
W[I]N       = /I2/                  as in 'WINDOW'
[IER]       = /E1 ER1/              as in 'CARRIER'
[IN]D       = /AI3 NN/              as in 'FIND'
#:R[IED]    = /E1 DD/               as in 'WORRIED'
[IED]b      = /AI3 DD/              as in 'FRIED'
FR[IEN]     = /EH2 N/               as in 'FRIEND'
[IEN]       = /E1 EH1 N/            as in 'AUDIENCE'
[IE]T       = /AI2 EH1/             as in 'DIET'
[IEL]       = /EELL/                as in 'FIELD'
b:[I]%      = /AI3/                 as in 'TRIES'
```

*Fig. 2g*

```
[EA]THEb      = /E3/          as in 'BREATHE'
[EA]THEDb     = /E3/          as in 'WREATHED'
N[EA]TH       = /E2/          as in 'BENEATH'
[EA]TH        = /EH2/         as in 'WEATHER'
[EALTH]       = /EH2 LL THF-/ as in 'WEALTH'
b*[EA]b       = /E3/          as in 'FLEA'
b*[EA]Sb      = /E3/          as in 'SEAS'
#:[EA]b       = /E2 UH1/      as in 'AREA'
#:[EAS]b      = /E2 UH1 ZZ/   as in 'AREAS'
[EAL]         = /EELL/        as in 'SEAL'
[EA]SU        = /EH2/         as in 'TREASURE'
[EA]VY        = /EH2/         as in 'HEAVY'
[EA]NT        = /EH2/         as in 'MEANT'
[EA].:b       = /E3/          as in 'BEAMS'
[EA].Eb       = /E3/          as in 'LEAVE'
[EA].ESb      = /E3/          as in 'LEAVES'
[EA]^         = /E2/          as in 'TEACH'
FOR[EIG]N     = /EH2/         as in 'FOREIGNER'
:[EIG]N       = /EI3/         as in 'FEIGN'
[EI]N:        = /EI3/         as in 'REINS'
[EI]N         = /EI2/         as in 'REIN'
[EIGH]b       = /EI3/         as in 'WEIGH'
[EIGH]%       = /EI3/         as in 'WEIGHTED
[EIGH]        = /EI2/         as in 'EIGHT'
[EI]          = /E2/          as in 'RECEIPT'
[EY]          = /EI3/         as in 'CONVEY'
#*[EY]        = /Y2/          as in 'MONKEY'
[EY]          = /E3/          as in 'KEY'
[EU]          = /Y U2/        as in 'HEURISTIC'
#:[E]Nb       = /EH1N/        as in 'CHICKEN'
#*[EN]LYb     = /EH1N N/      as in 'HEAVENLY'
#*[E]Mb       = /EH1N/        as in 'ANTHEM'
#*[E]MSb      = /EH1N/        as in 'ANTHEMS'
b[ENGL]       = /ING2 G2 L/   as in 'ENGLISH'
[E]N.:b       = /EH3/         as in 'SENDS'
[E]NSb        = /EH3/         as in 'HENS'
[E]N :b       = /EH2/         as in 'SPENT'
[E].          = /EH3/         as in 'RED'
[E]           = /EH2/         as in 'WET'
```

F-rules

```
b[F]b         = /EH2 FF/      as in 'F'
[F]Eb         = /FF/          as in 'WIFE'
[FUL]b        = /F LL/        as in 'FATEFUL'
[F]b          = /FF/          as in 'GAFF'
[F]F          = //            as in 'BAFFLE'
[F]           = /F/           as in 'FOR'
```

G-rules

```
b[G]b         = /J E3/        as in 'G'
[GI]V+N       = /GI I2/       as in 'GIVING'
[GIV]         = /G1 I3 V/     as in 'GIVE'
[GIRL]        = /G2 ER3 LL/   as in 'GIRL'
b[G]IT        = /G1/          as in 'GIT'
[G]E          = /JJ/          as in 'RAGE'
[GE]T         = /G1 EH2/      as in 'TOGETHER'
[GI]ON        = /J/           as in 'RELIGION'
[GI]O#^       = /J/           as in 'RELIGIOUS'
```

Fig. 2h

```
[I]%          = /E2/          as in 'WORRIES'
[IE].         = /E3/          as in 'LIEGE'
[IE]^         = /E2/          as in 'PIECE'
[IE]          = /E2/          as in 'PIECE'
#*[I]X        = /I1/          as in 'SUFFIX'
[I]X          = /I2/          as in 'FIXED'
bB[I]^+:#     = /AI2/         as in 'BICYCLE'
b[I]^+:#      = /AI2/         as in 'ITEMIZE'
b:[I] ELY     = /AI2/         as in 'LIKELY'
[I]^+:#       = /I2/          as in 'CONFIDENCE'
[IR]Eb        = /AI3 ER1/     as in 'FIRE'
[IR]ESb       = /AI3 ER1/     as in 'FIRES'
[IR]ED        = /AI3 ER1/     as in 'FIRED'
[IR]#         = /AI2 R/       as in 'IRIS'
[IZ]%         = /AI3 Z/       as in 'SIZES'
b[IS]L        = /AI2/         as in 'ISLAND'
[ISE]b        = /AI3 ZZ/      as in 'RISE'
[IS]%         = /AI3 Z/       as in 'RISES'
[I]D%         = /AI3/         as in 'RIDES'
#:[IO]N       = /Y UH1/       as in 'MILLION'
#:[IOR]       = /Y ER1/       as in 'BEHAVIOR'
#:[IC]%       = /I1 SS/       as in 'POULTICE'
#:#:[I] %     = /I1/          as in 'COMPOSITE'
[I].%         = /AI3/         as in 'HIDE'
[I] %         = /AI2/         as in 'SPITE'
+^[I]^+       = /I2/          as in 'IRIDESCENT'
#*[I] +       = /I1/          as in 'HUMANITY'
b*[I]TY       = /I2/          as in 'PITY'
[IS]+S        = /AI2/         as in 'CRISIS'
b*[I] I       = /I2/          as in 'CIVIL'
[I].+         = /AI3/         as in 'TINY'
[I] +         = /AI2          as in 'ICY'
[IR]b         = /ER3/         as in 'FIR'
[IR].:b       = /ER3/         as in 'THIRDS'
[IR]          = /ER2/         as in 'FIRMAMENT'
[IGH]b        = /AI3/         as in 'HIGH'
[IGHS]b       = /AI3 zz/      as in 'SIGHS'
[IGHED]       = /AI3 DD/      as in 'SIGHED'
[IGH]         = /AI2/         as in 'FIGHTER'
[ILD]         = /AI2 LL DD/   as in 'WILD'
[IL]          = /ILL/         as in 'HILL'
[IGN]b        = /AI3 NN/      as in 'SIGN'
[IGN]%        = /AI3 N/       as in 'SIGNS'
[IGN]^        = /AI2 N/       as in 'SIGNED'
[IGUE]        = /E2 KH-/      as in 'UNIGUE'
*Y*[I]        = /I1/          as in 'PHYSICAL'
b*[I]:AL      = /AI2/         as in 'TITLE'
b:[I] L%      = /AI2/         as in 'VITAL'
[I]:L%        = /I1/          as in 'IMPOSSIBLE'
[I]:AL        = /I1/          as in 'HOSPITAL'
bPR[I] A      = /I1/          as in 'PRIVATE;
[I]N.:b       = /AI2/         as in 'WIND'
[I]NSb        = /I3/          as in 'FINS'
[I]N          = /I2/          as in 'WINTER'
[I].          = /I3/          as in 'BID'
#*[I]         = /I1/          as in 'PUBLIC'
[I]           = /I2/          as in 'BIT'
```

J-rule

```
b[J]b         = /J EI3/       as in 'J'
[J]           = /J/           as in 'JUT'
```

*Fig. 2i*

K-rule

| | | |
|---|---|---|
| b[K]b | = /KH EI3/ | as in 'K' |
| b[K]N | = // | as in 'KNIGHT' |
| S[K]# | = /K2/ | as in 'SKATE' |
| [K]S | = /K2/ | as in 'WEEKS' |
| b[K]I^% | = /KH2/ | as in 'KITES' |
| [K]b | = /KH-/ | as in 'TOOK' |
| [K]% | = /KH-/ | as in 'SHAKE' |
| [K]I | = /KH1/ | as in 'MAKING' |
| [K]ER | = /KH/ | as in 'PARKER' |
| [K]% | = /K2/ | as in 'MAKES' |
| [K]+ | = /KH1/ | as in 'KEEP' |
| [K] | = /KH2/ | as in 'TOKEN' |

L-rule

| | | |
|---|---|---|
| b[L]b | = /EH2 LL/ | as in 'L' |
| [LOST] | = /L AW2 SS TH-/ | as in 'LOST' |
| [LO]C# | = /L OW2/ | as in 'LOCAL' |
| :[LOOD] | = /L UH3 DD/ | as in 'BLOOD' |
| [LL]b | = /LL/ | as in 'I'LL' |
| [LIV]Eb | = /L I3 VV/ | as in 'LIVE' |
| [LIV]% | = /L I2 V/ | as in 'LIVER' |
| [L]EARN | = /L/ | as in 'LEARNING' |
| [LEAR] | = /L EER3/ | as in 'CLEAR' |
| PP[LY] | = /L AI3/ | as in 'SUPPLY' |
| bREP]LY] | = /L AI3/ | as in 'REPLY' |
| b*[L]Yb | = /L/ | as in 'FLY' |
| EAL[L]Y | = / / | as in 'REALLY' |
| [LY]b | = /L Y2/ | as in 'LOVELY' |
| L[L] | = // | as in 'CALL' |
| #*[L]% | = /LL/ | as in 'BUBBLE' |
| [LEAD] | = /L E3 DD/ | as in 'LEAD' |
| VE[LO]PEb | = /L OW1/ | as in 'ENVELOPE' |
| VE[LO]P | = /L UH1/ | as in 'DEVELOP' |
| W[L] | = /L-/ | as in 'BOWL' |
| #:[L]b | = /LL/ | as in 'DAHL' |
| R[L] | = /LL/ | as in 'WORLD' |
| #[L]* | = /LL/ | as in 'CALL' |
| [LE]b | = /LL/ | as in 'TABLE' |
| #:[L]ESb | = /LL/ | as in 'ROLES' |
| #:[L]EDb | = /L/ | as in 'FOALED' |
| [L] | = /L/ | as in 'LEVER' |

M-rule

| | | |
|---|---|---|
| b[M]b | = /EH3 MM/ | as in 'M' |
| [MOW] | = /M OW3/ | as in 'MOW' |
| [MO]N | = /M UH2/ | as in 'MONDAY' |
| [MOVE] | = /M UU3 VV/ | as in 'REMOVE' |
| [MOV]# | = /M UU3 V/ | as in 'MOVING' |
| [MB]b | = /MM/ | as in 'LAMB' |
| [M]M | = // | as in 'COMMON' |
| #[M]Eb | = /MM/ | as in 'CANE' |
| [M]b | = /M/ | as in 'DAM' |
| [M] | = /M/ | as in 'MARRY' |

*Fig. 2j*

N-rules

```
b[N]b        = /EH3 NN/        as in 'N'
[N']         = /NN/            as in 'DON'T'
E[NG]+       = /N J/           as in 'ENGINE'
[NG]R        = /NG1 G2/        as in 'ANGRY'
[NG]+        = /NG1 G2/        as in 'FINGER'
[NGL]%       = /NG1 G2 LL/     as in 'ANGLE'
[NGU]%       = /NG2/           as in 'TONGUE'
[NG]         = /NG2/           as in 'SING'
[NK]b        = /NG1 KH-/       as in 'SINK'
[NEAR]L      = /N EER2/        as in 'NEARLY'
N[N]         = //              as in 'BANNER'
#:[N]ED      = /NN/            as in 'STRAINED'
[N]%         = /NN/            as in 'BANE'
[N]b         = /NN/            as in 'SUN'
[N]          = /N/             as in 'NO'
```

O-rules

```
[O]b         = /OW3/           as in 'GO'
[OF]b        = /UH2 VV/        as in 'OF'
b[OH]b       = /OW3/           as in 'OH'
[OROUGH]     = /ER2 OW3/       as in 'THOROUGH'
#:[OR]b      = /ER2/           as in 'COLOR'
#:[ORS]b     = /ER2 ZZ/        as in 'COLORS'
[ORDER]      = /OR2 D ER1/     as in 'ORDER'
[ORR]OW      = /AR2/           as in 'TOMORROW'
[OR].%       = /OR3/           as in 'FORGES'
[ORE]        = /OR3/           as in 'CORE'
[OR]         = /OR3/           as in 'FOR'
[OR]         = /OR3/           as in 'FORD'
[OR]         = /OR2/           as in 'ORANGE'
b[ONE]       = /W UH3 NN/      as in 'ONE'
#:Y[O]NE     = /W UH1N/        as in 'ANYONE'
KN]OW]L      = /AH2/           as in 'KNOWLEDGE'
b N[OW]I     = /OW2/           as in 'SNOWING'
b N[OW]      = /OW3/           as in 'SNOWS'
#*[OW]b      = /OW1/           as in 'WINDOW'
#*[OW]S      = /OW1/           as in 'WINDOWS'
#*[OW]%      = /OW1/           as in 'SHALLOWER'
b[OW]%       = /OW3/           as in 'OWE'
[OWL]        = /AU3 LL/        as in 'OWL'
[OW]ER:      = /AU2/           as in 'TOWER'
b[OW]N       = /OW3/           as in 'OWNED'
SH[OW]b      = /OW3/           as in 'SHOW'
SH[OW]ER     = /AU2/           as in 'SHOWER'
SH[OW]%      = /OW3/           as in 'SHOWING'
L[OW]        = /OW3/           as in 'GLOW'
:[OW]:       = /AU3/           as in 'DOWN'
^[O]:ATO     = /UH1/           as in 'POTATO'
b[OVER]      = /OW2 V ER2/     as in 'OVER'
[OV]Eb       = /UH3 VV/        as in 'LOVE'
[OV]         = /UH2 VV/        as in 'COVER'
[OY]         = /OI3/           as in 'TOY'
bR[OL]E      = /OW3 L-/        as in 'ROLES'
[O].%        = /OW3/           as in 'ODE'
[O]^%        = /OW2/           as in 'HOSES'
[O]^EN       = /OW2/           as in 'OPEN'
[O]^I#       = /OW2/           as in 'MOTION'
```

*Fig. 2k*

| | | |
|---|---|---|
| R[OLL]EDb | = /OW3 L-/ | as in 'ROLLED' |
| R[O]L:# | = /OW2/ | as in 'ROLLING' |
| R]OL]:b | = /OW3 L-/ | as in 'CONTROLS' |
| [OL]D | = /OW2 LL/ | as in 'OLD' |
| [OL]T | = /OW2 LL/ | as in 'COLT' |
| T[OU]CH | = /UH2/ | as in 'TOUCH' |
| C[OUN]TR | = /UH2 N/ | as in 'COUNTRIES' |
| D[OUGH] | = /OW3/ | as in 'DOUGH' |
| [OUGHT] | = /AW2 TH-/ | as in 'OUGHT' |
| [OUGH] | = /UH2 FF/ | as in 'TOUGH' |
| :[OULD] | = /003 DD/ | as in 'COULD' |
| b[OUR] | = /AU3 ER1/ | as in 'OURSELVES' |
| b[OU] | = /AU2/ | as in 'OUT' |
| H[OU]S# | = /AU2/ | as in 'HOUSE' |
| [OUS]b | = /UH1 SS/ | as in 'OBVIOUS' |
| [OUS]LYb | = /UH1 SS/ | as in 'OBVIOUSLY' |
| [OUR]. | = /OR3/ | as in 'GOURD' |
| [OUR]^ | = /OR2/ | as in 'COURT' |
| [OUR]b | = /OR3/ | as in 'YOUR' |
| ^[OU]^L | = /UH2/ | as in 'DOUBLE' |
| [OUP] | = /U2 PH-/ | as in 'SOUP' |
| [OU]. | = /AU3/ | as in 'LOUD' |
| [OU]^ | = /AU2/ | as in 'OUT' |
| [OING] | = /OW2 I1N NG2/ | as in 'GOING' |
| [OI]. | = /OI3/ | as in 'VOID' |
| [OI] | = /OI2/ | as in 'CHOICE' |
| [OOR] | = /OR3/ | as in 'POOR' |
| [OOR] | = /UU3/ | as in 'POORLY' |
| [OOR] | = /OR3/ | as in 'DOOR' |
| [OO]K | = /OO2/ | as in 'LOOK' |
| F[OO]D | = /UU3/ | as in 'FOOD' |
| R[OO] | = /UU2/ | as in 'ROOF' |
| [OOD] | = /003 DD/ | as in 'HOOD' |
| L[OO]. | = /UU3/ | as in 'BLOOM' |
| R[OO]. | = /UU3/ | as in 'ROOM' |
| L[OO] | = /UU2/ | as in 'ALOOF' |
| R[OO] | = /UU]/ | as in 'ROOF' |
| <[OO]. | = /UU3/ | as in 'POOL' |
| [OO]. | = /U3/ | as in 'TOOL' |
| [OO]b | = /UU3/ | as in 'BOO' |
| [OO]b | = /U3/ | as in 'TOO' |
| <[OO] | = /UU2/ | as in 'SWOOP' |
| [OO] | = /U2/ | as in 'SNOOP' |
| [O]E | = /OW3/ | as in 'TOE' |
| bAG[O]b | = /OW3/ | as in 'AGO' |
| #:[O]b | = /OW1/ | as in 'RADIO' |
| [OA]b | = /OW2 UH1/ | as in 'BOA' |
| [OAR] | = /OR3/ | as in 'SOAR' |
| [OA]. | = /OW3/ | as in 'LOAD |
| [OA]^ | = /OW2/ | as in 'BOAT' |
| b[ONLY] | = /OW2 N L Y2/ | as in 'ONLY' |
| b[ONCE] | = /W UH2 N SS/ | as in 'ONCE' |
| [ON'T] | = /OW2 N TH-/ | as in 'WON'T' |
| C[O]LOR | = /UH2/ | as in 'COLOR' |
| C[O]NG | = /AH2/ | as in 'CONGRESS' |
| C[O]N | = /AH2/ | as in 'CONFIDENCE' |
| [OMIC] | = /AH2 M I1 KH-/ | as in 'COMICAL' |
| C[O]M:#:# | = /UH1/ | as in 'COMMITTEE' |
| [O]NG | = /AW3/ | as in 'TONGS' |
| [O]NG | = /AW3/ | as in 'TONGS' |
| bT[O]*#* | = /UW1/ | as in 'TONIGHT' |
| b*[O]N | = /UH2/ | as in 'FRONT' |

Fig. 21

```
Y[O]ND      = /AH3/              as in 'BEYOND'
I[ON]       = /UH1 NN/           as in 'MENTION'
#:[ON]b     = /UH1 NN/           as in 'ION'
#^[ON]      = /UH1 NN/           as in 'DRAGON'
[O]STb      = /OW2/              as in 'HOST'
[O]F^       = /AW2/              as in 'OFTEN'
[OTHER]     = /UH2 THV ER2/      as in 'MOTHER'
[OSS]b      = /AW2 SS/           as in 'BOSS'
FR[O]M      = /UH3/              as in 'FROM'
N[O]TH      = /UH2/              as in 'NOTHING'
#*[OM]      = /UH2 MM/           as in 'APLOMB'
#:#[O]D:b   = /UH1/              as in 'PERIOD'
[O].        = /AH3/              as in 'COD'
[O]         = /AH2/              as in 'COT'
```

P-rules

```
b[P]b       = /PH E3/            as in 'P'
[PH]b       = /FF/               as in 'GRAPH'
[PH]        = /F/                as in 'PHILOSOPHY'
[PEOP]      = /PH E2 PH-/        as in 'PEOPLE'
[PUT]b      = /PH OO2 TH-/       as in 'PUT'
bS[P]       = /P/                as in 'SPACE'
[P]P        = / /                as in 'HAPPY'
[P]S        = /P/                as in 'LIPS'
[P]T        = /P/                as in 'APT'
[P]b        = /PH-/              as in 'ZAP'
#:[P]ESb    = /P/                as in 'HOPES'
#:[P]EDb    = /P/                as in 'HELPED'
[P]%        = /PH-/              as in 'HOPE'
[P]         = /PH/               as in 'PIE'
```

Q-rules

```
b[Q]b       = /KH1 Y U3/         as in 'Q'
S[QUAR]%    = /K2 W EHR3/        as in 'SQUARE'
b[QUAL]     = /KH2 W AW2 L/      as in 'QUALITY'
#[QUAL]     = /KH2 W UH1 LL/     as in 'EQUAL'
[QUAR]      = /KH2 W AW2 ER1/    as in 'QUARTER'
bS[QU]      = /K2 W/             as in 'SQUASH'
#:[QU]%     = /KH-/              as in 'TORQUE'
[QU]        = /KH2 W/            as in 'QUIT'
[Q]         = /KH2/              as in '????'
```

R-rules

```
b[R]b       = /AR3/              as in 'R'
'[RE]b      = /ER1/              as in 'YOU'RE'
b[RHYTH]M   = /R I2 THV/         as in 'RHYTHM'
b[RE]**     = /R E1/             as in 'REPLAY'
b[REAC]T    = /R E1 AE2 K2/      as in 'REACTION'
C[REAT]U    = /R E2 CH/          as in 'CREATURE'
C[REA]T+    = /R E1 EI2/         as in 'CREATION'
C[REAS]+    = /R E2 SS/          as in 'CREASE'
b[RI]V      = /R I2/             as in 'RIVER'
[R]OWL      = /R/                as in 'GROWL'
[ROW]S      = /R OW3/            as in 'GROWS'
G[ROW].     = /R OW3/            as in 'GROWN'
G[ROW]      = /R OW2/            as in 'GROWTH'
```

Fig. 2m

```
[ROW]b      = /R OW3/          as in 'CROW'
[ROW]%      = /R OW2/          as in 'ROWED'
[RUTH]      = /R U2 THF-/      as in 'TRUTH'
[R]         = /R/              as in 'RIGHT'
```

S-rules

```
b[S]b       = /EH2 SS/         as in 'S'
b[SAYS]b    = /S EH3 ZZ/       as in 'SAYS'
[SH]b       = /SH-/            as in 'WASH'
[SHALL]     = /SH AE3 LL/      as in 'SHALL'
[SHOULD]C   = /SH OW2 LL D/    as in 'SHOULDER'
[SHO]%      = /SH U3/          as in 'SHOES'
[SH]        = /SH/             as in 'SHINE'
#[SION]     = /ZH UH1 NN/      as in 'LESION'
[SPIR]IT    = /S P EER2/       as in 'SPIRIT'
[STOW]#     = /S T OW2/        as in 'STOWAWAY'
[STOW]b     = /S T OW3/        as in 'STOW'
[SOME]      = /S UH2 MM/       as in 'SOME'
#[SUR]#     = /ZH ER2/         as in 'MEASURE'
[SUR]#      = /SH ER2/         as in 'SURITY'
#[SU]#      = /ZH U1/          as in 'CASUAL'
#[SSU]#     = /SH U2/          as in 'ISSUE'
#[SED]b     = /ZZ DD/          as in 'USED'
^[S]Eb      = /SS/             as in 'TERSE'
#[S]Eb      = /ZZ/             as in 'TEASE'
#[S]#       = /Z/              as in 'EASY'
[SAID]      = /S EH3 DD/       as in 'SAID'
^[SION]     = /SH UH1 NN/      as in 'TENSION'
[S]S        = //               as in 'BOSS'
U[S]b       = /SS/             as in 'BUS'
.[S]b       = /ZZ/             as in 'BEDS'
#:.E[S]b    = /ZZ/             as in 'TROUBLES'
#:IE[S]b    = /ZZ/             as in 'PARTIES'
#*#E[S]b    = /ZZ/             as in 'VALUES'
#*#[S]b     = /SS/             as in 'BASIS'
b:#[S]b     = /ZZ/             as in 'TOES'
b[SCH]      = /S K2/           as in 'SCHOOL'
[S]C+       = //               as in 'SCIENCE'
#[SM]b      = /Z MM/           as in 'PLURALISM'
#[SN]'      = /Z UH1 N/        as in 'DOESN'T'
.'[S]       = /ZZ/             as in 'OUR'S'
.E'[S]      = /ZZ/             as in 'ADE'S'
b:E'[S]     = /ZZ/             as in 'HE'S'
[S]b        = /SS/             as in 'MISS'
[S]         = /S/              as in 'SISTER'
```

T-rules

```
b[T]b       = /TH E3/          as in 'T'
[T]S        = /T/              as in 'ITS'
[T]'S       = /T/              as in 'IT'S'
[T]ES       = /T/              as in 'STATES'
[T]CH       = //               as in 'CATCH'
b[THE]b     = /THV UH1/        as in 'THE'
[TO]b       = /TH U1/          as in 'TO'
[THAT]      = /THV AE2 TH-/    as in 'THAT'
b[THIS]     = /THV I2 SS/      as in 'THIS'
b[THEY]     = /THV EI3/        as in 'THEY'
b[THERE]    = /THV EHR2/       as in 'THERE'
```

*Fig.2n*

```
b[THER]#    = /THF EHR2/          as in 'THERAPY'
[THER]      = /THV ER1/           as in 'NEITHER'
[THEIR]     = /THV EHR2/          as in 'THEIR'
b[THAN]b    = /THV AE2 NN/        as in 'THAN'
b[THEM]     = /THV EH2 MM/        as in 'THEM'
[THESE]b    = /THV E3 ZZ/         as in 'THESE'
b[THEN]     = /THV EH3 NN/        as in 'THEN'
[THROUGH]   = /THF R U2/          as in 'THROUGH'
[THROW]N    = /THF R OW3/         as in 'THROWN
[THOSE]     = /THV OW3 ZZ/        as in 'THOSE'
[THOUGH]b   = /THV OW3/           as in 'THOUGH'
b[THUS]     = /THV UH2 SS/        as in 'THUS'
#[THE]b     = /THV-/              as in 'LITHE'
[TH]b       = /THF-/              as in 'WITH'
[TH]        = /THF/               as in 'WITHIN'
#:[TED]b    = /TH Y1 DD/          as in 'BLASTED'
[TI]M%      = /TH AI3/            as in 'SOMETIMES'
S[TI]#N     = /CH/                as in 'QUESTION'
S[TI]#N     = /CH/                as in 'QUESTION'
[TI]O       = /SH/                as in 'ACTION'
[TIA]       = /SH UH1/            as in 'MILITIA'
b[TO]TAL    = /TH OW2/            as in 'TOTALS'
[TUR]#      = /CH ER2/            as in 'FUTURE'
[TU]A       = /CH U1/             as in 'ACTUAL'
b[TWO]      = /TH U3/             as in 'TWO'
[T]T        = / /                 as in 'ATTACK'
[T]%        = /TH-/               as in 'BITE'
[T]b        = /TH-/               as in 'BIT'
bS[T]       = /T/                 as in 'STEAK'
[T]         = /TH/                as in 'TIME'
```

U-rules

```
b[U]b       = /Y U3/              as in 'U'
[UIL]^      = /I2 LL/             as in 'BUILD'
b[UN]I      = /Y U2 N/            as in 'UNITE'
b[UN]       = /UH1 N/             as in 'UNCOMMON'
[U]%        = /u3/                as in 'CLUE'
[U]%        = /Y U3/              as in 'CUE'
b[UPON]     = /UH1 PH AH2 NN/     as in 'UPON'
@[UR]#      = /OOR2/              as in 'ENDURE'
[UR]#       = /Y OOR2/            as in 'PURE'
[UR].       = /ER3/               as in 'URGE'
[UR]b       = /ER3/               as in 'FUR'
[UR]Sb      = /ER3/               as in 'FURS'
[UR]^       = /ER2/               as in 'PURSE'
F[ULL]      = /UHL/               as in 'FULL'
[ULL]       = /UHL/               as in 'PULL'
*[ULL]      = /ULL/               as in 'SKULL'
[UY]        = /AI3/               as in 'BUY'
[U]^Yb      = /UU2/               as in 'TRULY'
[U].b       = /UH3/               as in 'BUG'
[U].^       = /UH3/               as in 'BUGS'
[U]^b       = /UH2/               as in 'BUS'
[U]SH       = /OO2/               as in 'PUSH'
C[U]SH      = /OO2/               as in 'CUSHION'
T[U]SH      = /OO2/               as in 'TUSH'
[U]^^       = /UH2/               as in 'BUST'
bG[U]#      = //                  as in 'GUIDES'
G[U]%       = //                  as in 'VAGUELY'
G[U]#       = /W/                 as in 'ANGUISH'
```

Fig. 20

```
#N[U]      = /Y U2/              as in 'INURE
@[U]       = /U2/                as in 'CHUTE'
[U]        = /Y U2/              as in 'IMPUNITY'
```

V-rule

```
b[V]b      = /V E3/              as in 'V'
[VIEW]     = /V Y U3/            as in 'VIEW'
[V]Eb      = /VV/                as in 'LIVE'
[V]        = /V/                 as in 'VINE'
```

W-rule

```
b[W]b      = /D UH2 B LL Y U1/   as in 'W'
b[WERE]    = /W ER2/             as in 'WERE'
[WAS]N'    = /W UH1 Z/           as in 'WASN'T'
b[WAS]b    = /W UH1 ZZ/          as in 'WAS'
[WA]S      = /W AH2/             as in 'WASH'
[WA]T      = /W AH2/             as in 'WATT'
[WHERE]    = /WH EHR3/           as in 'WHERE'
[WHAT]     = /WH UH2 TH-/        as in 'WHAT'
[WHOLE]    = /HO OW3 LL/         as in 'WHOLE'
[WHO]      = /HO UU2/            as in 'WHO'
[WHY]      = /WH AI3/            as in 'WHY'
[WH]       = /WH/                as in 'WHICH'
[WAR]%     = /W EHR3/            as in 'BEWARE'
[WAR]      = /W AW2 ER1/         as in 'WAR'
[WOR].     = /W ER3/             as in 'WORD'
[WOR]^     = /W ER2/             as in 'WORST'
[WR]       = /R/                 as in 'WRITE'
ANS[W]     = / /                 as in 'ANSWERED'
[W]        = /W/                 as in 'WIFE'
```

X-rule

```
b[X]b      = /EH2 K2 SS/         as in 'X'
[XAC]      = /G2 Z AE2 K2/       as in 'EXACTLY'
[X]b       = /K2 SS/             as in 'BOX'
[X]        = /K2 S/              as in 'BOXER'
```

Y-rules

```
b[Y]b      = /W AI3/             as in 'Y'
[YOUNG]    = /Y UH2 NG1/         as in 'YOUNGER'
[YOUNG]    = /Y UH3 NG2/         as in 'YOUNG'
b[YOU]b    = /Y U3/              as in 'YOU'
[YOUR]     = /Y OOR3/            as in 'YOUR'
b[YOU]^    = /Y U2/              as in 'YOUTH'
b[YES]     = /Y EH2 SS/          as in 'YES'
b[Y]       = /Y/                 as in 'YELLOW'
#*[Y]      = /Y2/                as in 'BUNNY'
#*[Y]I     = /Y1/                as in 'ATROPHYING'
b:[Y]b     = /AI3/               as in 'TRY'
b:[Y]%     = /AI3/               as in 'TRYING'
#[Y]#      = /Y/                 as in 'SAYING'
b:[Y] + : # = /I2/               as in 'SYZYOY'
b:[Y]^#    = /AI2/               as in 'TYKE'
[Y]        = /I2/                as in 'BICYCLE'
```

*Fig. 2p*

Z-rules

```
b[Z]b       = /Z E3/          as in 'Z'
[ZAN]+      = /Z EI2 N/       as in 'ZANY'
[Z]Eb       = /ZZ/            as in 'MAZE'
[Z]b        = /ZZ/            as in 'BUZZ'
[Z]Z        = //              as in 'BUZZING'
[Z]         = /Z/             as in 'ZAP'
```

END OF THE RULES

Allophone code description

| Allophone | | Description |
|---|---|---|
| 1 | AE1 | as in ".A.DDITION" |
| 2 | AE1N | as in ".A.NNUITY" |
| 3 | AE2 | as in "HAT" |
| 4 | AE3 | as in "HAD" |
| 5 | AH1 | as in "DELT.A." |
| 6 | AH1N | as in ".O.N TIME" |
| 7 | AH2 | as in "HOT" |
| 8 | AH3 | as in "ODD" |
| 9 | AI2 | as in "HEIGHT" |
| 10 | AI3 | as in "HIDE" |
| 11 | AR2 | as in "CART" |
| 12 | AR3 | as in "CARD" |
| 13 | AU2 | as in "HOUSE" |
| 14 | AU3 | as in "LOUD" |
| 15 | AW1 | as in ".AU.TONOMY" |
| 16 | AW1N | as in "AN.O.NIMITY" |
| 17 | AW2 | as in "SOUGHT" |
| 18 | AW3 | as in "SAW" |
| 19 | E1 | as in ".E.LIMINATE" |
| 20 | E1N | as in ".E.NOUGH" |
| 21 | E2 | as in "HEAT" |
| 22 | E3 | as in "SEED" |
| 23 | EELL | as in "HEEL" |
| 24 | EER2 | as in "PIERCE" |
| 25 | EER3 | as in "HEAR" |
| 26 | EH1 | as in "CONT.E.XT" |
| 27 | EH1N | as in "ANCI.E.NT" |
| 28 | EH2 | as in "SET" |
| 29 | EH3 | as in "SAID" |
| 30 | EHR2 | as in "TH.ER.APY" |
| 31 | EHR3 | as in "THERE" |
| 32 | EI2 | as in "TAKE" |
| 33 | EI3 | as in "DAY" |
| 34 | ER1 | as in "SEEK.ER" |
| 35 | ER1N | as in "WEST.ER.N" |
| 36 | ER2 | as in "HURT" |
| 37 | ER3 | as in "HEARD" |
| 38 | I1 | as in "SYNTH.E.S.I.S" |
| 39 | I1N | as in ".I.NANE" |

Fig. 5a

| | | |
|---|---|---|
| 40 | I2 | as in ".I.SSUE" |
| 41 | I3 | as in "HID" |
| 42 | ILL | as in "HILL" |
| 43 | ING2 | as in "THINK" |
| 44 | O1 | as in "RATI.O." |
| 45 | O1N | as in "D.O.NATION" |
| 46 | OI2 | as in "CHOICE" |
| 47 | OI3 | as in "BOY" |
| 48 | OO1 | as in "T.OO.K ON" |
| 49 | OO2 | as in "COOK" |
| 50 | OO3 | as in "COULD" |
| 51 | OOR2 | as in "POORLY" |
| 52 | OOR3 | as in "POOR" |
| 53 | OR2 | as in "HORSE" |
| 54 | OR3 | as in "CORE" |
| 55 | OW2 | as in "BOAT" |
| 56 | OW3 | as in "LOW" |
| 57 | U1 | as in "ANN.U.AL" |
| 58 | U1N | as in ".U.NIQUE" |
| 59 | U2 | as in "SHOOT" |
| 60 | U3 | as in "SHOE" |
| 61 | UH1 | as in ".A.BOVE" |
| 62 | UH1M | as in "INSTR.U.MENTS" |
| 63 | UH1N | as in ".U.NERNEATH" |
| 64 | UH2 | as in "HUT" |
| 65 | ULL | as in "SK.U LL." |
| 66 | UHL | as in "P.ULL." |
| 67 | UH3 | as in "MUD" |
| 68 | UU2 | as in "BOOT" |
| 69 | UU3 | as in "MOON" |
| 70 | Y1 | as in "ROS.E.S" |
| 71 | Y1N | as in "BASEM.E.NT" |
| 72 | Y2 | as in "FUNN.Y." |
| 73 | LL | as in "AWF.UL.","WE.LL." |
| 74 | B | as in "BAD" |
| 75 | BB | as in "DAB" |
| 76 | D | as in "DIG" |
| 77 | DD | as in "BID" |
| 78 | G1 | as in "GIVE" |
| 79 | G2 | as in "GO" |
| 80 | GG | as in "BAG" |
| 81 | K2 | as in "SKATE" |
| 82 | KH | as in "CASE" |
| 83 | KH- | as in "MAKE" |
| 84 | KH1 | as in "KEY" |
| 85 | KH2 | as in "COUGH" |
| 86 | P | as in "SPACE" |
| 87 | PH | as in "PIE" |
| 88 | PH- | as in "NAP" |
| 89 | T | as in "STAKE" |
| 90 | TH | as in "TIE" |
| 91 | TH- | as in "LATE" |
| 92 | CH | as in "CHURCH" |
| 93 | F | as in "FAT" |
| 94 | FF | as in "LAUGH" |

Fig. 5b

| | | |
|---|---|---|
| 95 | HI | as in "HIT" |
| 96 | HO | as in "HOME" |
| 97 | HUH | as in "HUT" |
| 98 | J | as in "JUG" |
| 99 | JJ | as in "BUDGE" |
| 100 | L | as in "LIKE" |
| 101 | L- | as in "BOWL" |
| 102 | M | as in "MAY" |
| 103 | MM | as in "HUM" |
| 104 | N | as in "NICE" |
| 105 | NN | as in "SANE" |
| 106 | NG1 | as in "THINK" |
| 107 | NG2 | as in "THING" |
| 108 | R | as in "REAL" |
| 109 | S | as in "SEEM" |
| 110 | SS | as in "MISS" |
| 111 | SH | as in "SHINE" |
| 112 | SH- | as in "WASH" |
| 113 | THF | as in "THING" |
| 114 | THF- | as in "WITH" |
| 115 | THV | as in "THIS" |
| 116 | THV- | as in "CLOTHE" |
| 117 | V | as in "VINE" |
| 118 | VV | as in "LIVE" |
| 119 | W | as in "WITCH" |
| 120 | WH | as in "WHICH" |
| 121 | Y | as in "YOU" |
| 122 | Z | as in "ZOO" |
| 123 | ZZ | as in "DOES" |
| 124 | ZH | as in "AZURE" |
| 125 | ZH- | as in "BEIGE" |
| 126 | Pause | (short pause) |
| 127 | Pause | (long pause) |

*Fig. 5c*

JOINS FIG. 9F
36
52
40
PRIMARY LAST VOWEL
NO
Q OR S ?
S
4
FIRST FRAME
YES
NO
Pi = Pi-1 +1 IF Pi ≤BP+2
OTHERWISE Pi = BP+2
Pi = Pi-1 +2
Pi = Pi-1
Q OR S ?
Q
S
Pi = Pi-1 -1 IF Pi ≥BP-D
OTHERWISE, Pi = BP-D
Pi = Pi-1 +1 IF Pi ≤BP+D,
OTHERWISE, Pi = BP+D
SEND E. Pi, Ki, K2-K10
TO 286
3

37
40
LAST VOWEL ?
YES
NO
QUESTION OR STATEMENT ?
Q
S
FIRST FRAME ?
NO
YES
Pi = Pi-1-1 IF Pi >, BP-D OTHERWISE' Pi = BP-D
Pi = BP+D-2
Pi = BP-D+2
Pi = Pi-1+1 IF OTHERWISE ·Pi≪BP+D Pi ≐ BP+D
QUESTION OR STATEMENT
S
Q
FIRST FRAME
YES
NO
Pi = BP+D-2 PV = Pi
Pi = BP-D+2 BP = BP+D-2 P2 = BP-D # OF SECONDARY = 2
Pi = Pi-1
JOINS FIG. 9D
JOINS FIG. 9I

JOINS FIG. 9H
JOINS FIG. 9E
OF SECONDARY = 1 ?
FIRST FRAME
FIRST FRAME ?
YES
NO
Pi = P2
Pi = Pi-1
P2 = P2 + 2 IF P2 ≤ BP; P2 = BP
Pi = P2
P2 = Pi
PV = PV-2 IF PV >, BP-D OTHERWISE PV = BP-D
Pi = PV+1
Pi = Pi-1
Pi = PV
Pi=Pi-1-1 IF Pi;≥BP-D; OTHERWISE Pi = BP-D
Pi= Pi-1+1 IF Pi ≤ BP+2; OTHERWISE Pi = BP+2
PV = PV-2 IF PV ≥ BP-D3 OTHERWISE. PV = BP-D
40
39
43
44
45
46
47
48
49
50
51

TEXT-TO-SPEECH SYNTHESIS SYSTEM

BACKGROUND OF THE INVENTION

1. Field of the Invention

This invention pertains to electronic text-to-speech synthesizing a system and more particularly to systems that receives digital code such as ASCII representative of characters, determines an allophonic code for each incoming character set and sends such allophonic code to a speech producing system which decodes the allophonic code and assigns pitch for synthesizing, in an LPC speech synthesizer, speech-like sound, having unlimited vocabulary.

2. DESCRIPTION OF THE PRIOR ART

Waveform encoding and parameter encoding generally categorize the prior art techniques. Waveform encoding includes uncompressed digital data-pulse code modulation (PCM), delta modulation (DM), continuous variable slope delta modulation (CVSD) and a technique developed by Mozer (see U.S. Pat. No. 4,214,125). Parameter encoding includes channel vocoder, Formant synthesis, and linear predictive coding (LPC).

PCM involves converting a speech signal into digital information using an A/D converter. Digital information is stored in memory and played back through a D/A converter through a low-pass filter, amplifier and speaker. The advantage of this approach is its simplicity. Both A/D converters and D/A converters are available and relatively inexpensive. The problem involved is the amount of data storage required. Assuming a maximum frequency of 4K Hz, and further assuming each speech sample being represented by 8 to 12 bits, one second of speech requires 64K to 96K bits of memory.

DM is a technique for compressing the speech data by assuming that the analog-speech signal is either increasing or decreasing in amplitude. The speech signal is sampled at a rate of approximately 64,000 times per second. Each sample is then compared to the estimated value of the previous sample. If the first value is greater than the estimated value of the latter, then the slope of the signal generated by the model is positive. If not the slope is then negative. The magnitude of the slope is chosen such that it is at least as large as the maximum expected slope of the signal.

CVSD is a technique that is an extension of DM which is accomplished by allowing the slope of the generated signal to vary. The data rate in DM is typically in the order of 64K bits per second and in CVSD it is approximately 16K–32K bits per second.

The Mozer technique takes advantage of the periodicity of voiced speech waveform and the perceptual insensitivity to the phase information of the speech signal. Compressing the information in the speech waveform requires phase-angle adjustment to obtain a time-symmetrical pitch waveform which makes one-half of the waveform redundant; half period zeroing to eliminate relatively low-power segments of the waveform; digital compression using DM and repetition of pitch periods to eliminate redundant (or similar) speech segments. The data rate of this technique is approximately 2.4K bits per second.

In parameter encoding schemes, speech characteristics other than the original speech waveform are used in the analysis and synthesis. These characteristics are used to control the synthesis model to create an output speech signal which is similar to the original. The commonly used techniques attempt to describe the spectral response, the spectral peaks or the vocal tract.

The channel vocoder has a bank of band-pass filters which are designed so that the frequency range of the speech signal can be divided into relatively narrow frequency ranges. After the signal has been divided into the narrow bands the energy is detected and stored for each band. The production of the speech signal is accomplished by a bank of narrow band frequency generators, which correspond to the frequencies of the band-pass filters, controlled by pitch information extracted from the original speech signal. The signal amplitude of each of the frequency generators is determined by the energy of the original speech signal detected during the analysis. The data rate of the channel vocoder is typically in the order of 2.4K bits per second.

In formant synthesis, the short time frequency spectrum is analyzed to the extent that the spectral shape is recreated using the formant center frequencies, their band-widths and the pitch period as the inputs. The formants are the peaks in a frequency spectrum envelope. The data rate for formant synthesis is typically 500 bits per second.

Linear predictive coding (LPC) can best be described as a mathematical model of the human vocal tract. The parameters used to control the model represent the amount of energy delivered by the lungs (amplitude), the vibration of the vocal cords (pitch period and the voiced/unvoiced decision), and the shape of the vocal tract (reflection coefficients). In the prior art, LPC synthesis has been accomplished through computer simulation techniques. More recently, LPC synthesizers have been fabricated in a semiconductor, integrated circuit chip such as that described and claimed in U.S. Pat. No. 4,209,836 entitled "Speech Synthesis Integrated Circuit Device" and assigned to the assignee of this invention.

This invention is a combination of a speech construction technique and a speech synthesis technique. The prior art set out above involves synthesis techniques.

With respect to speech construction techniques, the library of available component sounds includes phonemes, allophones, diphones, demisyllables, morphs and combinations of these sounds.

Speech construction techniques involving phonemes are flexible techniques in the prior art. In English, there are 16 vowel phonemes and 24 consonant phonemes making a total of 40. Theoretically, any word or phrase desired should be capable of being constructed from these phonemes. However, when each phoneme is actually pronounced there are many minor variations that may occur between sounds, which may in turn modify the pronunciation of the phoneme. This inaccuracy in representing sounds causes difficulty in understanding the resulting speech produced by the synthesis device.

Another prior art construction technique involves the use of diphones. A diphone is defined as the sound that extends from the middle of one phoneme to the middle of the next phoneme. It is chosen as a component sound to reduce smoothing requirements between adjacent diphones. However, to encompass many of the coarticulation effects in English, a large inventory of diphones is usually required. The storage requirement is in the order of 250K bytes, with a computer required to handle the construction program.

Demisyllables have been used in the prior art as component sounds for speech construction. A syllable in any language may be divided into an initial demisyllable, final demisyllable and possible phonetic affixes. The initial demisyllable consists of any initial consonants and the transition into the vowel. The final demisyllable consists of the vowel and any co-final consonants. The phonetic affixes consist of all syllable-final non-core consonants. The prior art system requires a library of 841 initial and final demisyllables and 5 phonetic affixes. The memory requirement is in the order of 50K bytes.

A morph is the smallest unit of sound that has a meaning. In a prior art system, for unrestricted English text, a dictionary of 12,000 morphs was used which required approximately 600K bytes of memory. The speech generated is intelligible and quite natural but the memory requirement is prohibitive.

An allophone is a subset of a phoneme, which is modified by the environment in which it occurs. For example, the aspirated /p/ in "push" and the unaspirated /p/ in "Spain" are different allophones of the phoneme /p/. Thus, allophones are more accurate in representing sounds than phonemes. According to the present invention, 127 allophones are stored in 3,000 bytes of memory. The storage requirement is much less than the aforementioned system using diphones, demisyllables and morphs.

Text-to-speech synthesizer systems have been fabricated using phonemes and formant synthesis. This invention utilizes the flexibility of allophones coupled with LPC synthesis.

BREIF SUMMARY OF THE INVENTION

In this preferred embodiment, digital information in the form of ASCII code is serially entered into the system. The ASCII code may be entered from a local or remote terminal, a keyboard, a computer, etc. Of course, the particular code is simply a matter of choice and is not important to this invention. The character code is received by a microcontroller which interrogates a set of rules located in a read-only memory (ROM) to get a match for a particular character set. The rules are made up of characters which are dependent upon neighboring characters for the selection of allophonic codes. Each character set is compared with its appropriate rule character sets until a match is found. In this preferred embodiment, the information is set in the ROM in the form of ASCII code so that a direct comparison of ASCII code is made. When a match is found, the allophonic code corresponding to the matched allophone is retrieved. It is to be understood, however, that other sound components such as the aforementioned phonemes, diphones, demisyllables and morphs in coded forms are also contemplated for use with this LPC synthesizer. Furthermore, the allophonic code in this preferred embodiment is contemplated for use in other digital synthesizers as well as the LPC synthesizer of this preferred embodiment.

An allophone library is stored in a ROM. A microprocessor receives the allophonic code and addresses the ROM at the address corresponding to the particular allophonic code entered. An allophone, represented by its speech parameters, is retrieved from the ROM, followed by other allophones forming the words and phrases. A dedicated micro-controller is used for concatenating (stringing) the allophones to form the words and phrases. When stringing allophones, an interpolation frame of 25ms is created between allophones to smooth out sound transitions in LPC parameters. However, no interpolation is required when the voicing transition occurs. Energy is another parameter that must be smoothed. To obtain an overall smooth energy contour for the strung phrases, interpolation frames are usually created at both ends of the string with energy tapered toward zero. The smoothing technique described subsequently herein reduces the abrupt changes in sound which are usually perceived as pops, squeaks, squeals, etc.

Stress and intonation greatly contribute to the perceptual naturalness and contextual meaning of constructive speech. Stress means the emphasis of a certain syllable within a word, whereas intonation applies to the overall up-and-down patterns of pitch within a multisyllable word, phrase or sentence. The contextual meaning of a sentence may be changed completely by assigning stress and intonation differently. Therefore, English does not sound natural if it is randomly intoned. The stress and intonation patterns which are a part of the speech construction technique herein contribute to the understandability and naturalness of the resulting speech. Stress and intonation are based on gradient pitch control of the stressed syllables preceding the primary stress of the phrase. All the secondary stress syllables of the sentence are thought of as lying along a line of pitch values tangent to the line of the pitch values of the unstressed syllables. The unstressed syllables lie on a mid-level line of pitch, with the stress syllables lying on a downward slanted tangent to produce an overall down drift sensation. The user is required to mark stressed syllables in the allophonic code. The stressed syllables then become the anchor point of the pitch patterns. A microprocessor automatically assigns the appropriate pitch values to the allophones which have been strung.

At this point, there exists an inventory of LPC parameters which have been strung together and designated in pitch as set out above. The LPC parameters are then sent to the speech synthesis device, which in this preferred embodiment is the device described in U.S. Pat. No. 4,209,836 mentioned earlier and which is incorporated herein by reference. The smoothing mentioned above is accomplished by circuitry on the synthesizer chip. The smoothing could also be accomplished through the microprocessor.

The principal object of this invention is to provide a text-to-speech system that has unlimited vocabulary in any language.

It is another object of this invention to provide an economic mechanism for producing speech-like sounds that are good in quality, with an unlimited vocabulary, from a textual code input.

Another object of this invention is to provide a text-to-speech system which is low cost in terms of storage and yet provides understandable synthetic speech.

It is still another object of this invention to provide a text-to-speech system which employs a digital, semiconductor integrated circuit LPC synthesizer in combination with concatenated sound input originated through text code to provide an unlimited vocabulary.

A further object of this invention is to provide a stress and intonation pattern to the input textual material so that the pitch is adjusted automatically according to a natural sounding intonation pattern at the output.

An all encompassing object of this invention is to provide a highly flexible, low cost text-to-speech system with the advantages of unlimited vocabulary and good speech quality.

These and other objects will be made evident in the detailed description that follows.

FIGS. *2a–2p* illustrate the allophone rules.

FIGS. *3a–3f* form a flowchart illustrating the operation of the rules processor.

Figure 4:
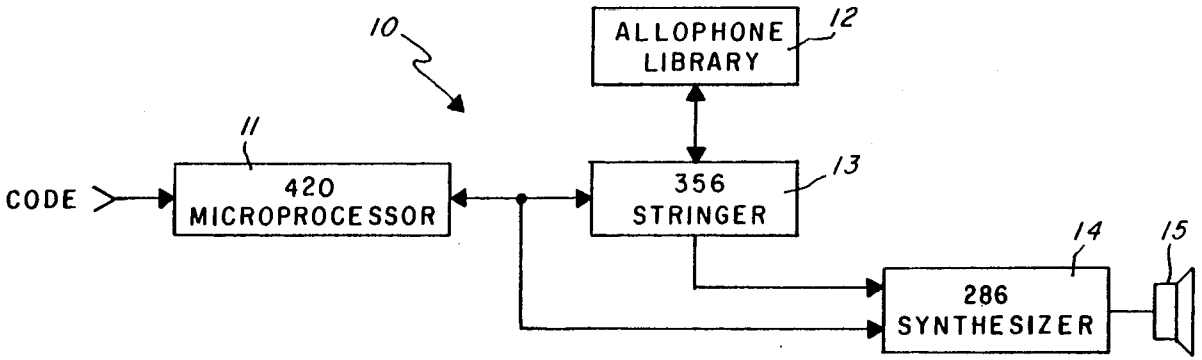

FIG. 4 is a block diagram of the speech producing system.

FIGS. *5a–5c* form a description of the allophone library.

Figure 6:
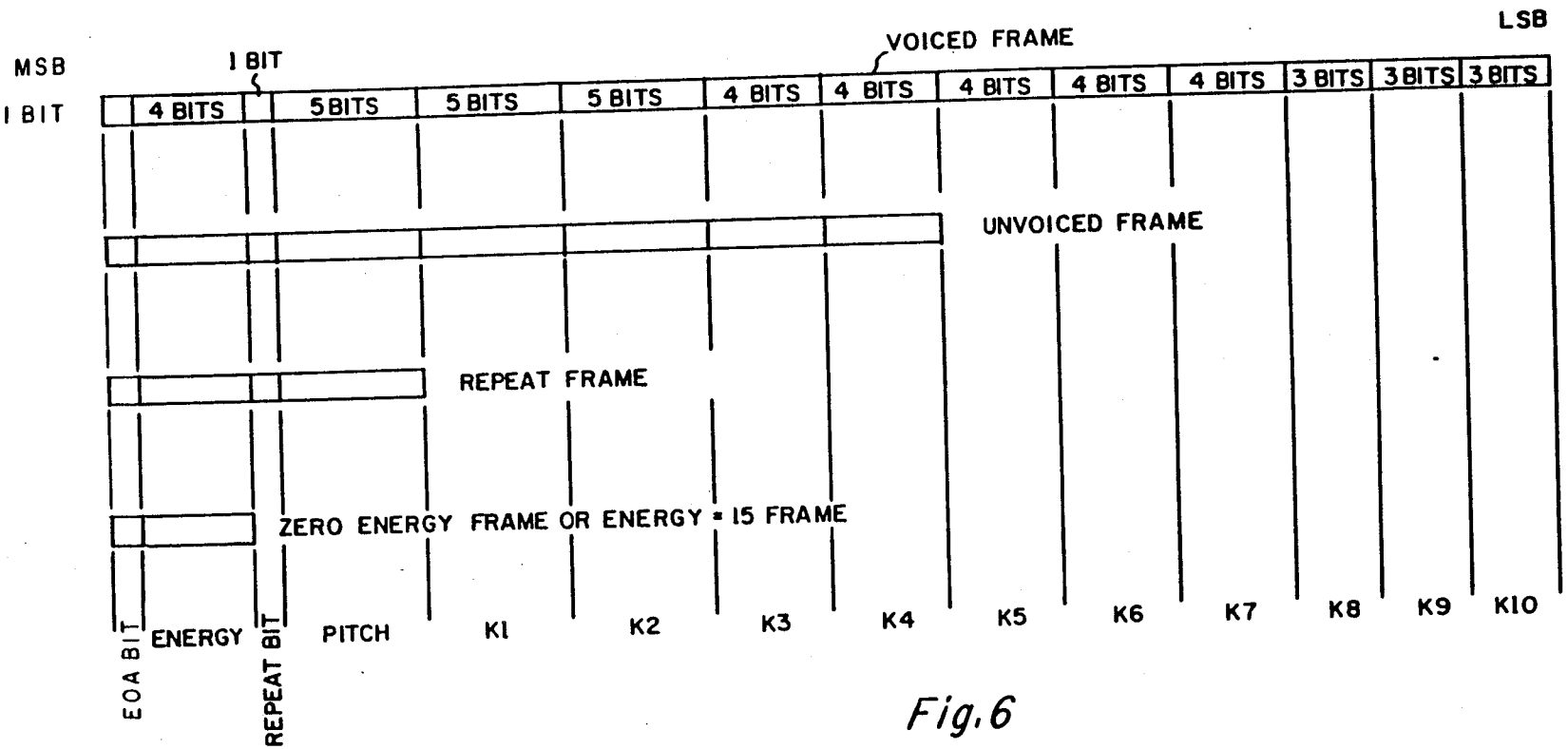

FIG. 6 illustrates the synthesizer frame bit content.

Figure 7:
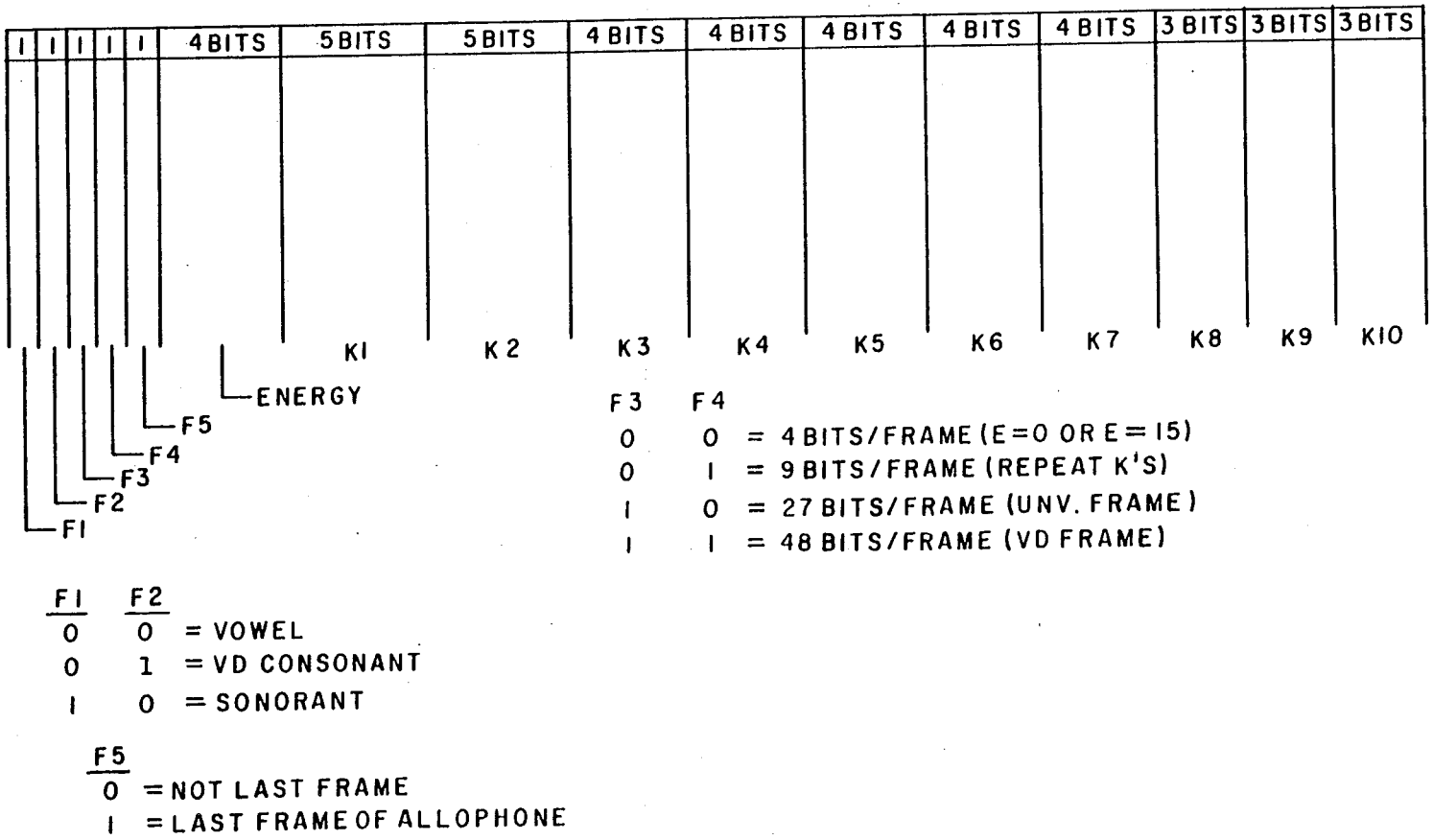

FIG. 7 ilustrates the allophone library bit content.

FIGS. *8a* and *8b* form a flowchart describing the operation of the microprocessor of the system.

FIGS. *9a–9i* form a flowchart describing the intonation pattern structuring.

DETAILED DESCRIPTION OF THE INVENTION

Figure 1:
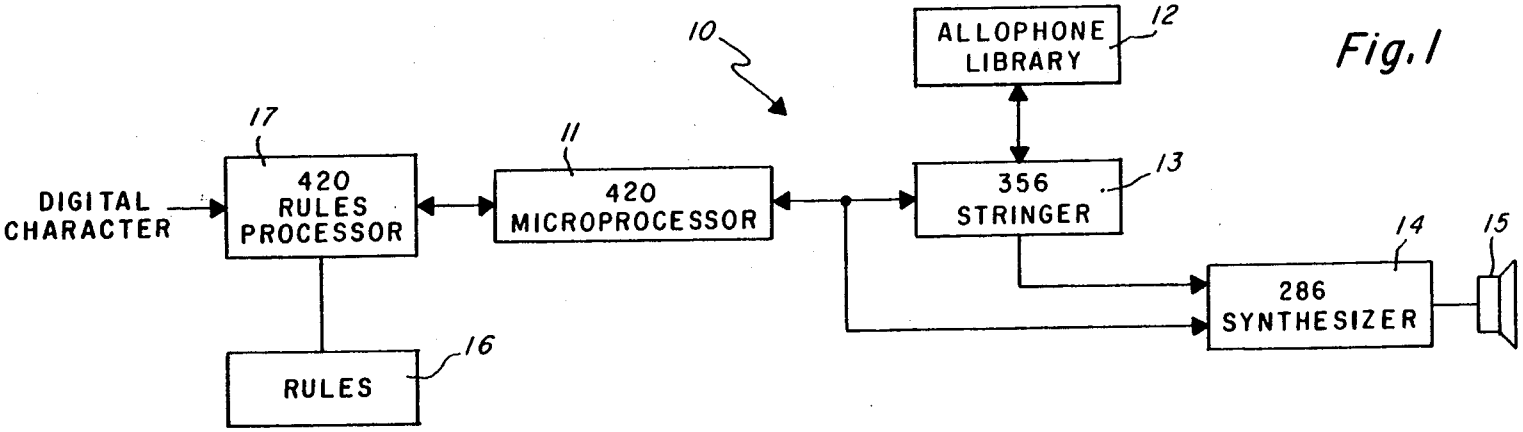
FIG. 1 is a block diagram of the inventive text-to-speech system.

FIG. 1 illustrates the text-to-speech system 10 having a 420 rules processor 17 with a digital character input (ASCII) for comparison to the rules 16 which are stored in a ROM. The rules processor 17 may be a Texas Instruments Incorporated Type TMCO420 microcomputer, for example, or any suitable signal processor. The rules ROM 16 may be a Texas Instruments Incorporated Type TMCO420 microcomputer, for example, or any suitable signal processor. The rules ROM 16 may be Texas Instruments Type TMS6100 (TMC350) voice synthesis memory which is a ROM internally organized as 16K×8 bits.

The allophonic code retrieved from rules ROM 16 is entered in the system 420 microprocessor 11 which is connected to control the stringer controller 13 and synthesizer 14. The output of synthesizer 14 is through speaker 15 which produces speech-like sounds in response to the input allophonic code.

The 356 stringer controller 13 may be a Texas Instruments Incorporated Type TMCO356 microcomputer, for example, or any suitable signal processor. Allophone library 12 may be a Texas Instruments Type TMS6100 ROM also. It may or may not be included because the TMC0356 microcomputer which may be employed as the stringer controller 13 has an internal ROM which may be used to contain the library. The 420 system midroprocessor 11 also may be a Texas Instruments Incorporated Type TMC0420 microcomputer.

Synthesizer 14 is fully described in previously mentioned U.S. Pat. No. 4,209,836. However, in addition, the 286 synthesizer 14 has the facility for selectively smoothing between allophones and has circuitry for providing a selection of speech rate which is not part of this invention.

FIGS. *2a–2p* set out the allophone rules. For example, in the A rules [AW]b outputs the allophonic code for /AW3/ which is pronounced as the "a" in "saw". Note that the "A" sounds are categorized in one group followed by the "B" sounds, etc. These are listed as "A" rules, "B" rules, "C" rules and so on.

FIGS. *3a–3f* form the flowchart detailing the operation of the 420 rules processor 17 in searching the rules ROM 16 for each of the incoming digital characters. The appropriate allophonic code is retrieved and stress is assigned.

Referring first to FIG. *3a*, the system is initialized, and the rule file is opened. The 420 rules processor 17 is thereby instructed to read information from the rules ROM 16 and to do the matching. The first character input (in ASCII) code in this preferred embodiment, is shifted to the right and then the first character is skipped. The first character is a space because of the shift to the right and is skipped so that when a comparison is made, it is noted that the neighboring character to the left of the next character is a space and the proper allophonic code can be assigned. Then the next character is read and the question "end of text?" is asked. If the answer is yes, the routine goes to "STRESS" on FIG. *3b*. If the answer is no, the rules are read out until a match is made. Each rule contains the ASCII characters set to define an allophone and the corresponding allophonic code. When a match is made, the allophonic code is read out to "STRESS" of FIG. *3b*, and the next character is obtained.

Coming in through "STRESS" on FIG. *3b*, a pointer receives the beginning of the display buffer. The pointer also gets the beginning of the allophone buffer. Then the question "?" is asked. If the answer is true, "?" is deleted from queue 1 and it is determined whether the allophone starts with "wh". If the answer is true, then a question bit flag is set. If the answer is "no", the question bit flag is cleared. Then a reset word/phrase bit is set, and a reset allophone/allophone-bit flag is reset, followed by the beginning of the allophone buffer sent to the pointer. FIG. *3b*, it is seen, is dedicated to concatenating the flags.

In FIG. *3c*, the question is asked if the allophone=00. If the answer is false, a pointer is incremented until the allophone=00. When it does, it is determined whether the allophone number is less than 48 hexadecimal. If the answer is true, a vowel is indicated (as shown in the allophone library) and the last vowel gets the value of the pointer. If the answer is false, then the pointer is decremented becaus the first vowel received will actually be the last vowel.

The pointer receives the beginning of the allophone buffer and the primary receives a 1 with the vowel receiving a 0 in an initialization process.

Figure 3A:
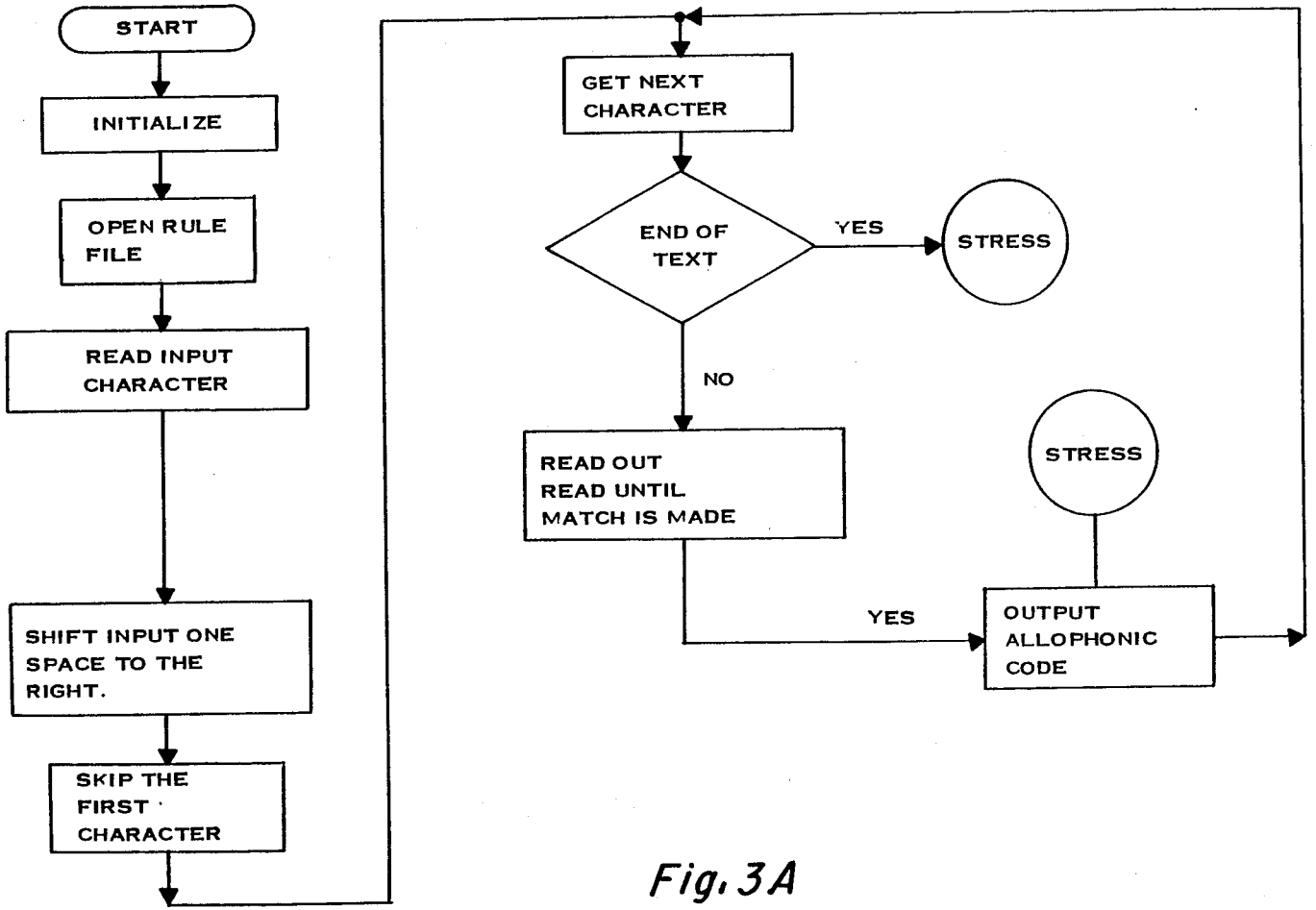
Figure 3B:
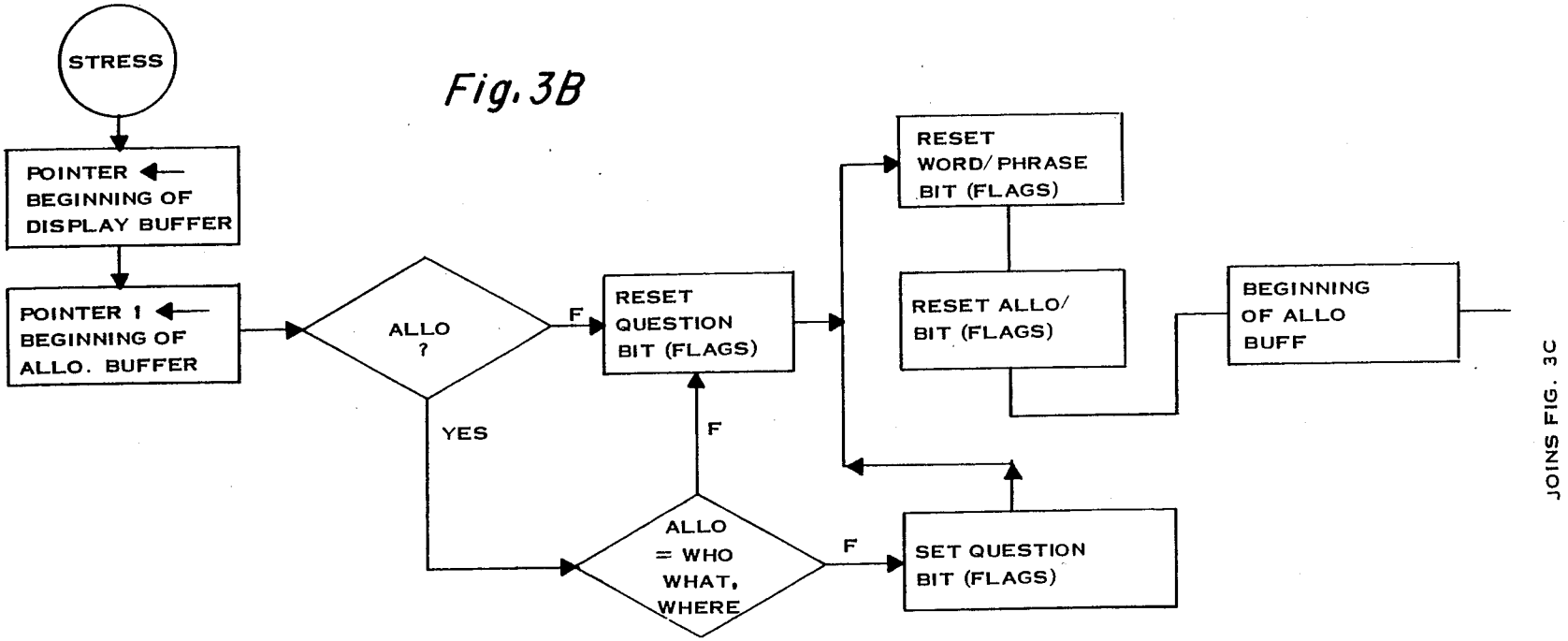
Figure 3C:
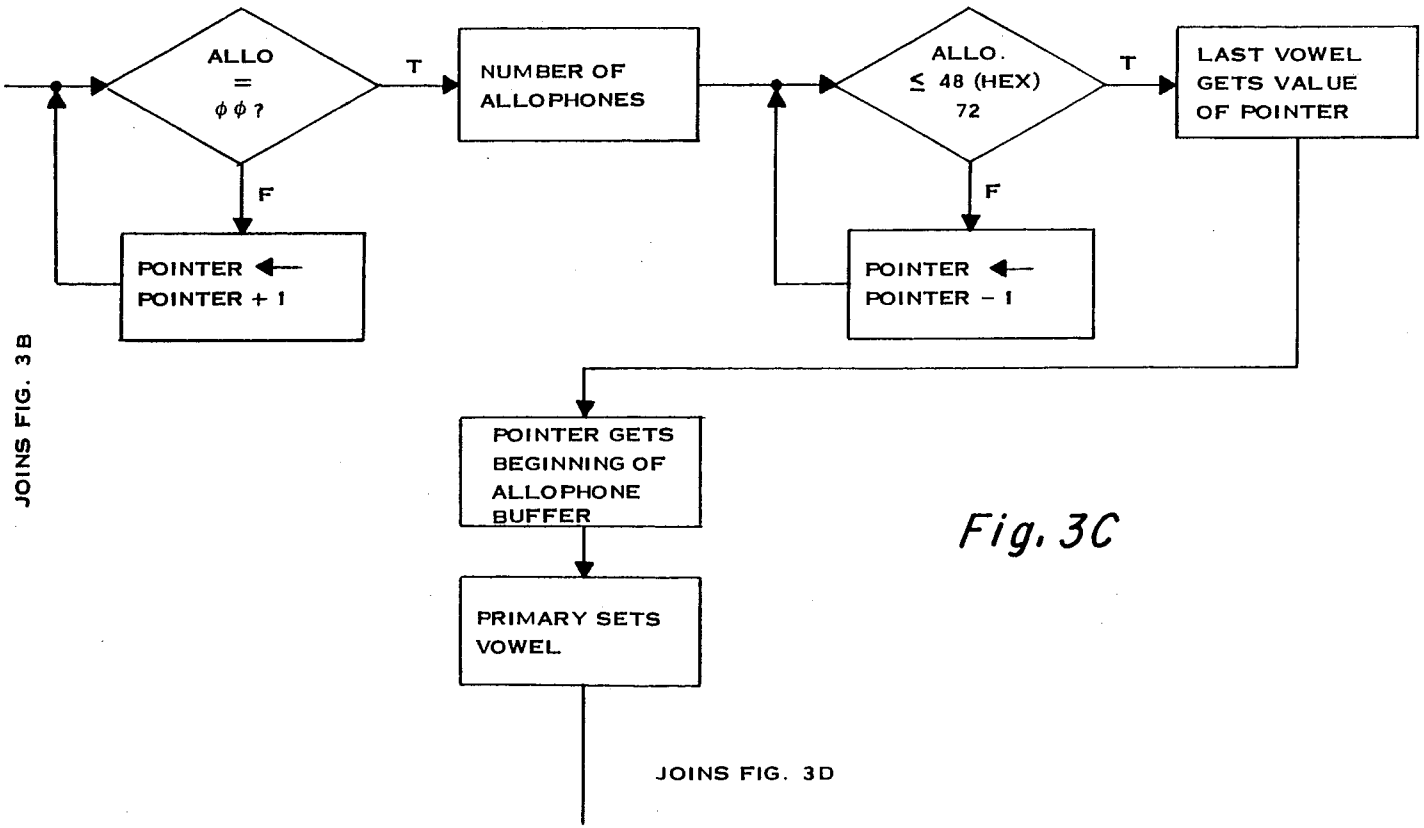
Figure 3D:
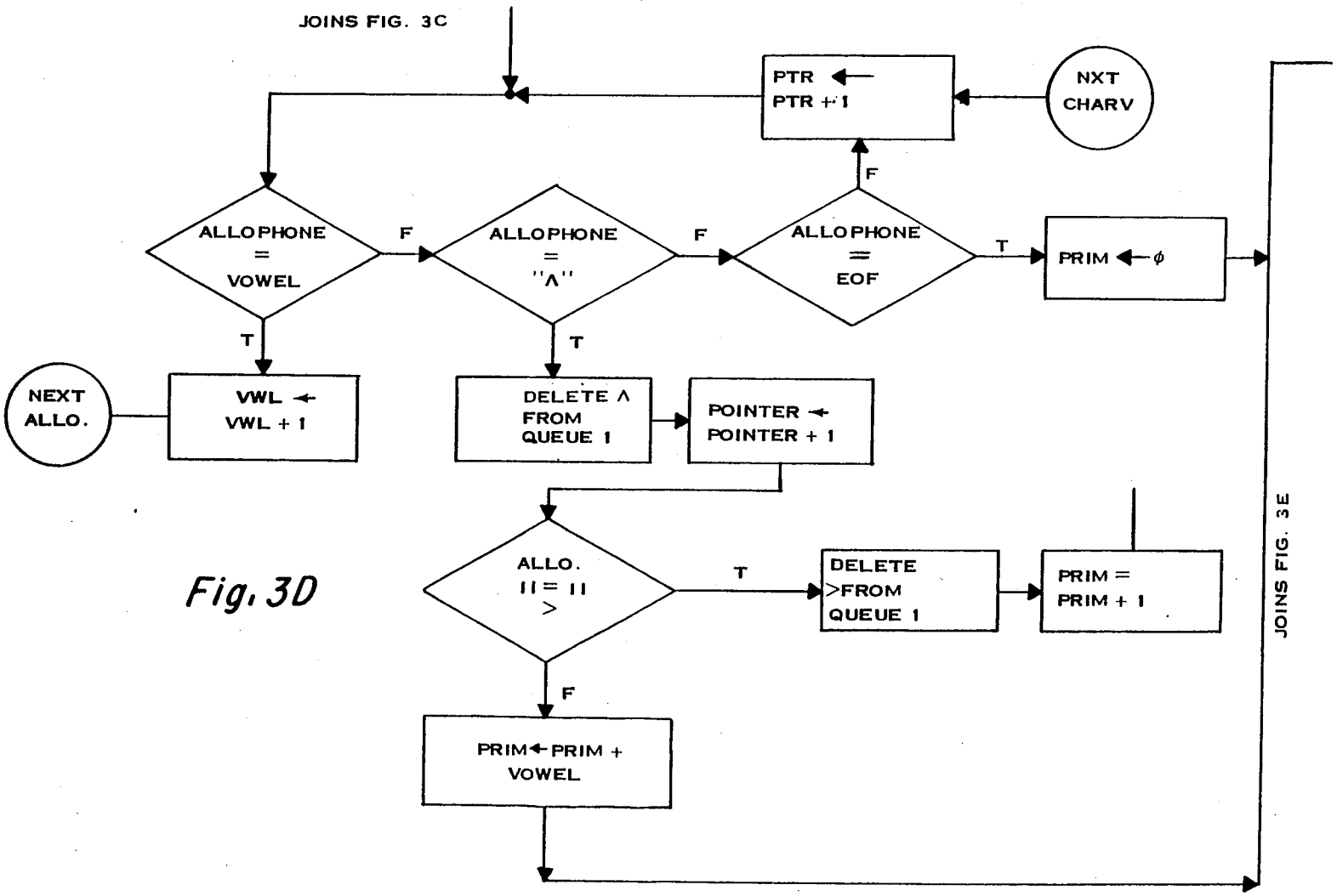
Figure 3E:
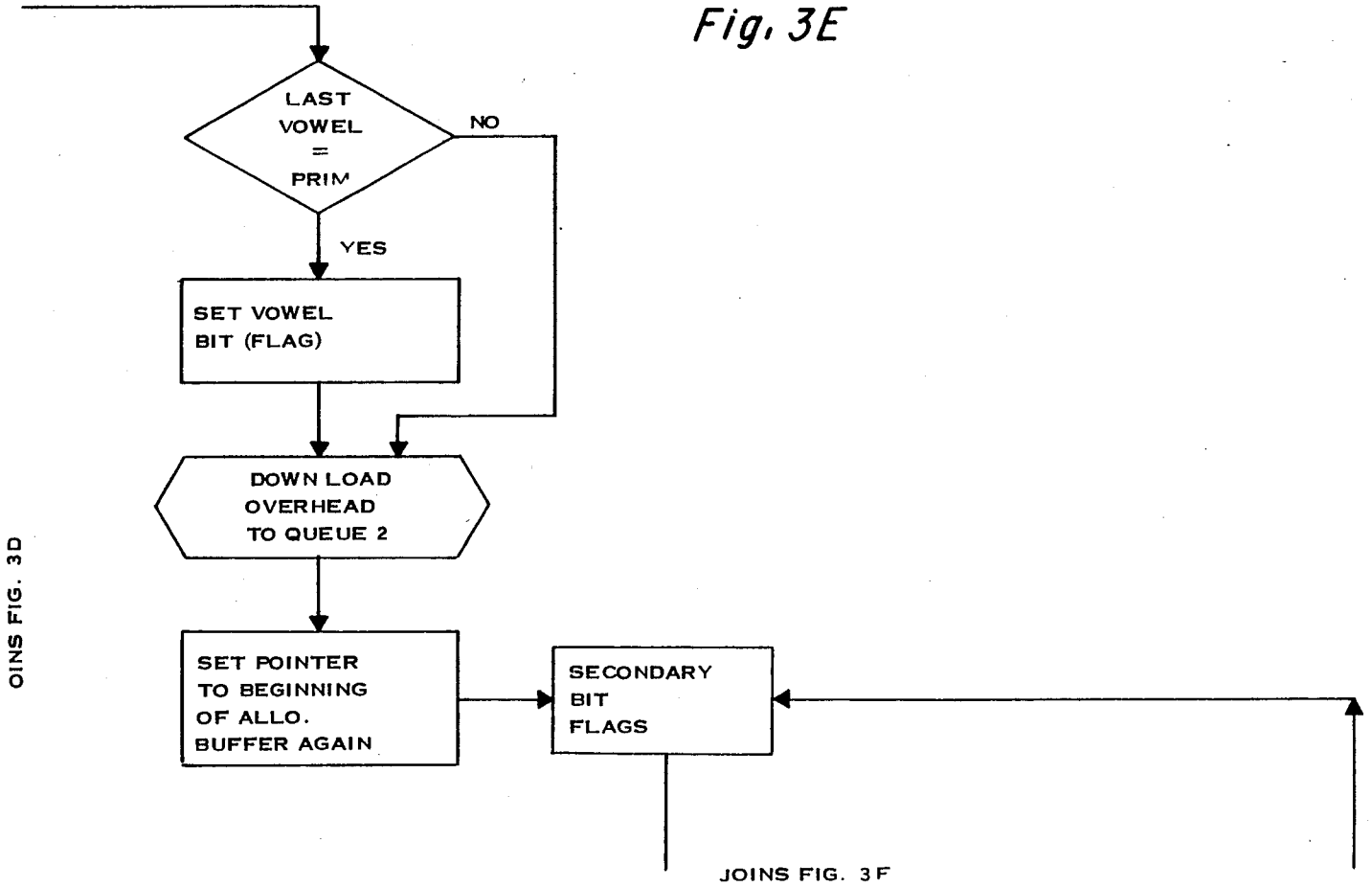
Figure 3F:
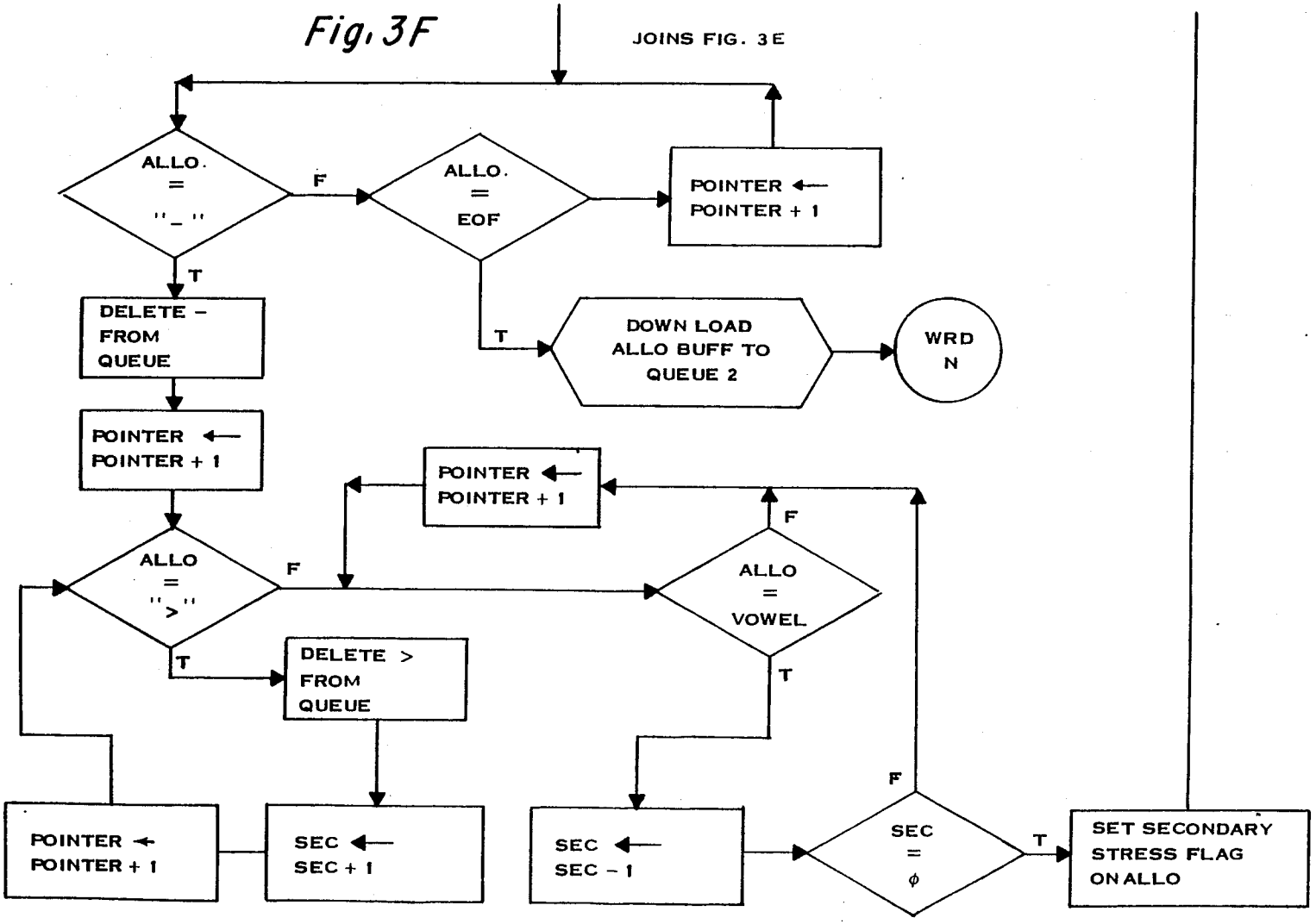

In FIG. *3d*, it is determined whether the allophone is a vowel. If the answer is true, then the vowel number is incremented by 1 and the next allophone is called. If the answer is false, it is then determined whether the allophone is a "∧". If the answer is true, a primary stress is indicated and the code for "∧" must be eliminated from the assembly queue 1. Then the pointer is incremented and it is determined whether the next allophone is a ">". If the answer is true, ">" is eliminated from queue 1 and it is indicated that the primary stress will be skipped to the next vowel. Therefore, the primary notation is incremented and the pointer is again incremented. If the answer is false, the primary is increased by the sum of primary+vowel to determine which vowel gets the primary stress. If it is determined that there is no "∧", then no primary stress is indicated and it is determined whether the allophone is the end of frame. If the answer is false, the pointer is incremented and the routine shown in FIG. *3b* is repeated. If it is an end of frame, then the primary is reset to 0 and it is determined as shown in FIG. *3e* whether the last vowel receives the primary stress. If the answer is yes, then a vowel bit flag is set. If the answer is no, the vowel bit flag is not set. In either event, the information thus derived (overhead) is sent to queue 2 which is the speaking queue. Next, the pointer is set to the beginning of the allophone buffer. The secondary bit flag is initialized and then, in FIG. 3*f*, it is determined whether the allophone is a "—", indicating a secondary stress. If the answer is true, then the "—" must be removed from queue 1 and the pointer is indexed. Next it is determined whether the following allophone is a ">", indicating that the next vowel is to receive the secondary stress. If the answer is true, then the code for ">" must be deleted from queue 1 and the secondary flag is incremented by 1 and the question whether a skip is to be performed is again asked. If there is no skip, then it is determined whether the allophone is a vowel. If the answer is false, the pointer is incremented by 1 until a vowel is reached. If the answer is true, then the secondary stress flag is decremented by 1 and the question is asked whether the secondary is now equal to 0. If the answer is true, a secondary stress flag is set as indicated on FIG. 3*f*. If the answer is false, the pointer is incremented.

If it is indicated that the allophone is the end of the frame, then allophone buffer is down loaded to queue 2, the speaking queue.

FIG. 4 is a block diagram of the speech producing syste which has been described in association with FIG. 1.

FIGS. 5*a* through 5*c* illustrate the allophones within the allophone library 12. For example, allophone 18 is coded within ROM 12 as "AW3" which is pronounced as the "a" in the word "saw". Allophone 80 is set in the ROM 12 as code corresponding to allophone "GG" which is pronounced as the "g" in the word "bag". Pronunciation is given for all of the allophones stored in the allophone library 12.

Each allophone is made up of as many as 10 frames, the frames varying from four bits for a zero energy frame, to ten bits for a "repeat frame" to 28 bits for a "unvoiced frame" to 49 bits for a "voiced frame". FIG. 6 illustrates this frame structure. A detailed description is present in previously mentioned U.S. Pat. No. 4,209,836.

In this preferred embodiment, the number of frames in a given allophone is determined by a well-known LPC analysis of a speaker's voice. That is, the analysis provides the breakdown of the frames required, the energy for each frame, and the reflection coefficients for each frame. This information is stored then to represent the allophone sounds set out in FIGS. 5*a*–5*c*.

Figure 9A:
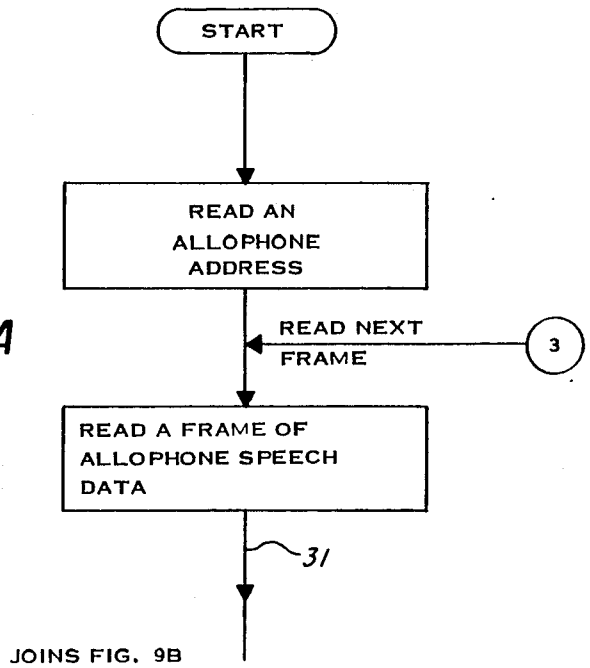

Smoothing between certain allophones is accomplished by circuitry illustrated in FIGS. 7*a* and 7*a* (cont'd) of U.S. Pat. No. 4,209,836. In FIGS. 7*a* and 7*a* (cont'd), signal $\overline{\text{SLOW D}}$ is applied to parameter counter 513, which causes a frame width of 25 MS to be slowed to 50 MS. Interpolation (smoothing) is performed by the circuitry shown in FIGS. 9*a*, 9*a* (cont'd), 9*b*, 9*b* (cont'd) over a 50 MS period when signal $\overline{\text{SLOW D}}$ present and over a 25 MS period when signal $\overline{\text{SLOW D}}$ is absent. In the invention of U.S. Pat. No. 4,209,836, a switch was set to cause slow speech through signal $\overline{\text{SLOW D}}$. All frames were lengthened in duration.

In the present invention, $\overline{\text{SLOW D}}$ is present only when the last frame in an allophone is indicated by a single bit in the frame. The actual interpolation (smoothing) circuitry and its operation are described in detail in U.S. Pat. No. 4,209,836.

FIG. 6 illustrates the bit formation of the allophone frame received by the 286 synthesizer 14. As shown, MSB the end of allophone (EOA) bit. When EOA=1, it is the last frame in the allophone. When EOA=0, it is not the last frame in the allophone. FIG. 6 illustrates a total of 50 bits (including EOA) for the voiced frame, 29 bits for the unvoiced frame, 11 bits for the repeat frame and 5 bits for the zero energy frame or the energy equals 15 frame.

FIG. 7 illustrates an allophone frame from the allophone library 12. F1–F5 are each one bit flags with F5 being the EOA bit which is transferred to the 286 synthesizer 14. The combination of flags F1 and F2 and the combination of flags F3 and F4 are shown in FIG.7 and the meaning of those combinations set out.

Figure 8A:
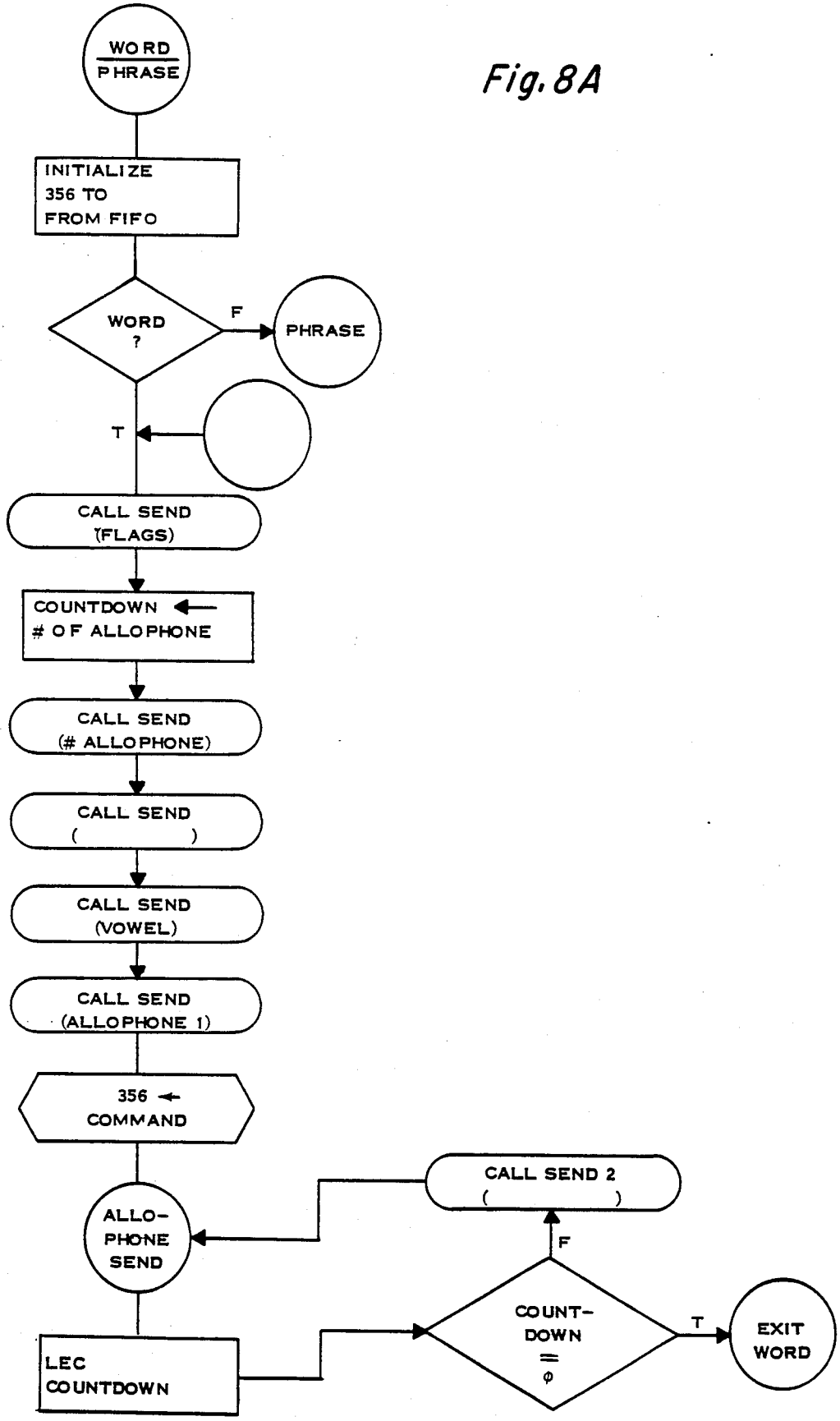
Figure 8B:
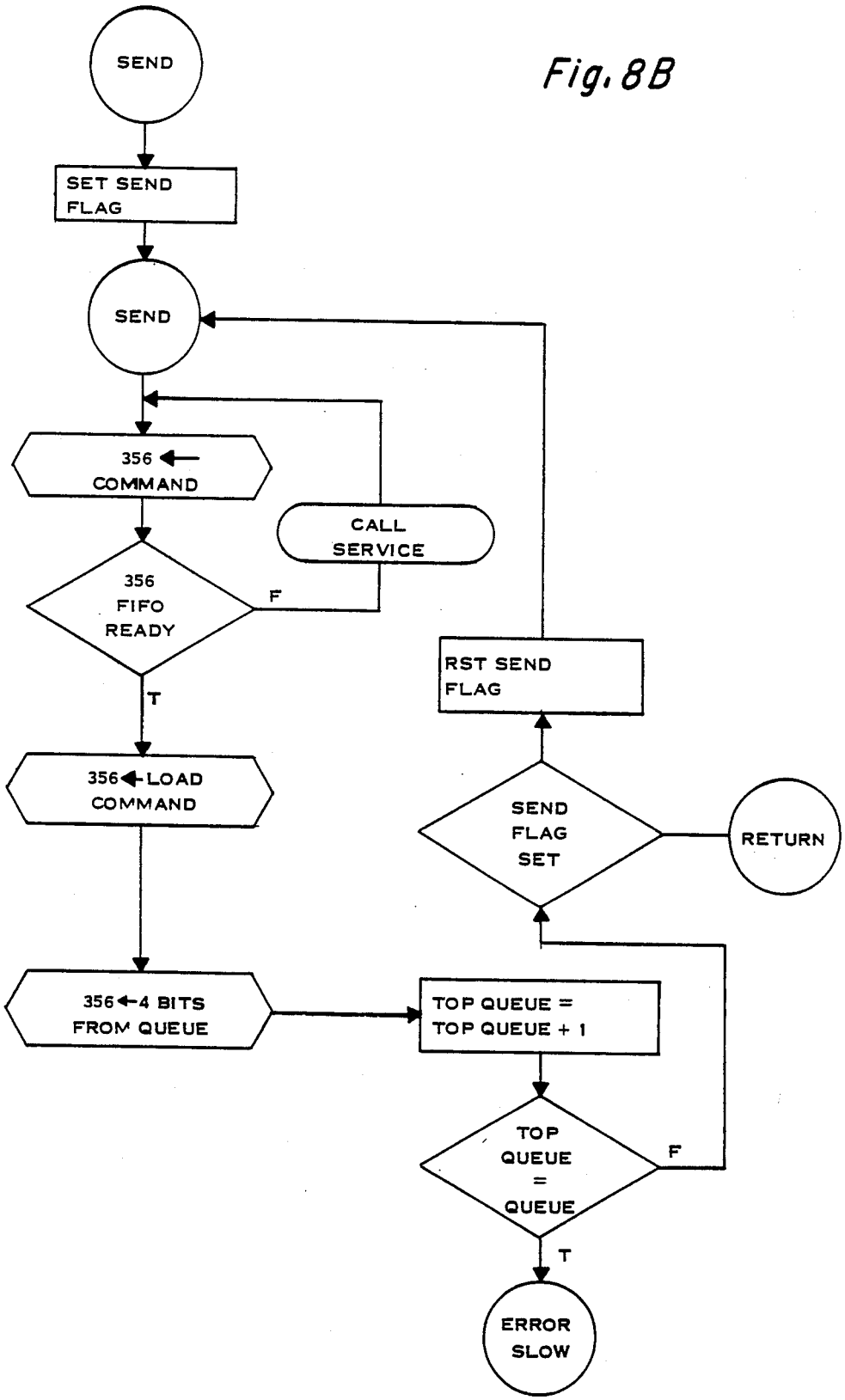

FIGS. 8*a* and 8*b* form a flowchart illustrating the details of control exerted by the 420 microprocessor 11 over, primarily, the 356 stringer 13. Beginning at "word/phrase", the first-in, first-out (FIFO) register of the 356 stringer 13 is initialized to receive the allophonic code from 420 microprocessor 11. Next it is determined whether the incoming information is simply a word or a phrase. If it is simply a word, then the call routine is brought up to send flag information representative of allophones, the primary stress and which vowel is the last in the word. The number of allophones is set in a countdown register and the number of allophones is sent to the 356 stringer 13.

The primary stress to be given is sent, followed by the information as to which vowel is the last one in the word. Finally, a send 2 is called to send the entire 8 bits (7 bits allophone, 1 bit stress flag). It should be noted that the previous send routine involved sending only 4 bits.

A send 2 flag is set and a status command is sent to the 356 stringer 13. Then, if the 356 FIFO is ready to receive information, the FIFO is loaded.

Four bits are then sent from the 420 microprocessor 11 queue register to the FIFO of the 356 stringer 13. The queue is incremented and checked to determine whether it has been emptied. If it has been emptied, there is an error. If it has not been emptied, then the send 2 flag is interrogated. If it is not set, then the routine returns to the send 2 call mentioned above. If the flag is set, then it is cleared and the next four bits are brought in to go through the same routine as indicated above.

When the return is made, an execute command is sent to the 356 stringer 13 after which a status command is sent. If the 356 stringer 13 is ready, a speak command is given. If it is not ready, the status command is again sent until the stringer 13 is ready. Then the allophone is sent and the countdown register containing the number of allophones is decremented. If the countdown equals zero, the routine is again started at word/phrase. If the countdown is not equal to zero, then the send 2 routine is again called and the next allophone is brought with the procedure being repeated until the entire word has been completed.

If a phrase had been sent rather than a word, then and similar to the case of the single word, status flags are sent, and the call routine is sent, indicating first the number of words, then the primary stress, and then the base pitch and the delta pitch. At that point, the routine returns to word/phrase and is identical to that set out above.

FIGS. 9*a*–9*i* form a flowchart of the details of the control of the action of the 356 stringer 13 on the allophones. Beginning in FIG. 9*a*, the starting point is to "read an allophone address" and then to "read a frame of allophone speech data". On path 31 to FIG. 9*b*, a decision block inquiring "first frame of the allophone" is reached. If the answer is "yes", then it is necessary to decode the flags F1–F5. If the answer is "no", then it is necessary to only decode flags F3, F4 and F5. As indicated above, flags F1 and F2 determine the nature of the allophone and need not be further decoded. After the decoding, in either case, a decision block is reached where it is necessary to determine whether F3 F4=00. If the answer is "yes" then the energy is 0 and a decision is made as to whether F5=1, indicating the last frame in the allophone. If the answer is yes, then the decision is reached as to whether it is the last allophone. If the answer is "yes", the routine has ended. If F5 is not equal to 1, then E=0 is sent to the 286 synthesizer 14 and the next frame is brought in as indicated on FIG. 9*a*. If F5=1, and it is not the last allophone, then the information E=0 and F5=1 is sent to the 286 synthesizer 14 and the next allophone is called starting at the beginning of the routine.

If F3 F4 is not equal to 00, then it is determined whether F3 F4=01, indicating a 9 bit word because a repeat, using the same K parameters, is to follow. If the answer is "no", then on path 32 to FIG. 6*c*, it is determined whether F3 F4=10, indicating 27 bits for an unvoiced frame. If the answer is "yes", the first four bits are read as energy. Five bits for pitch are created as 0 and the next four bits are read as K1–K4. Then energy and pitch=0 and K1–K4 are sent to the 286 synthesizer 14. If F3 F4≠10, then F3 F4=11 indicating a voiced 48 bit frame and the first four bits are read as energy, the next five bits are created as pitch and the ten K parameters are read.

Figure 9B:
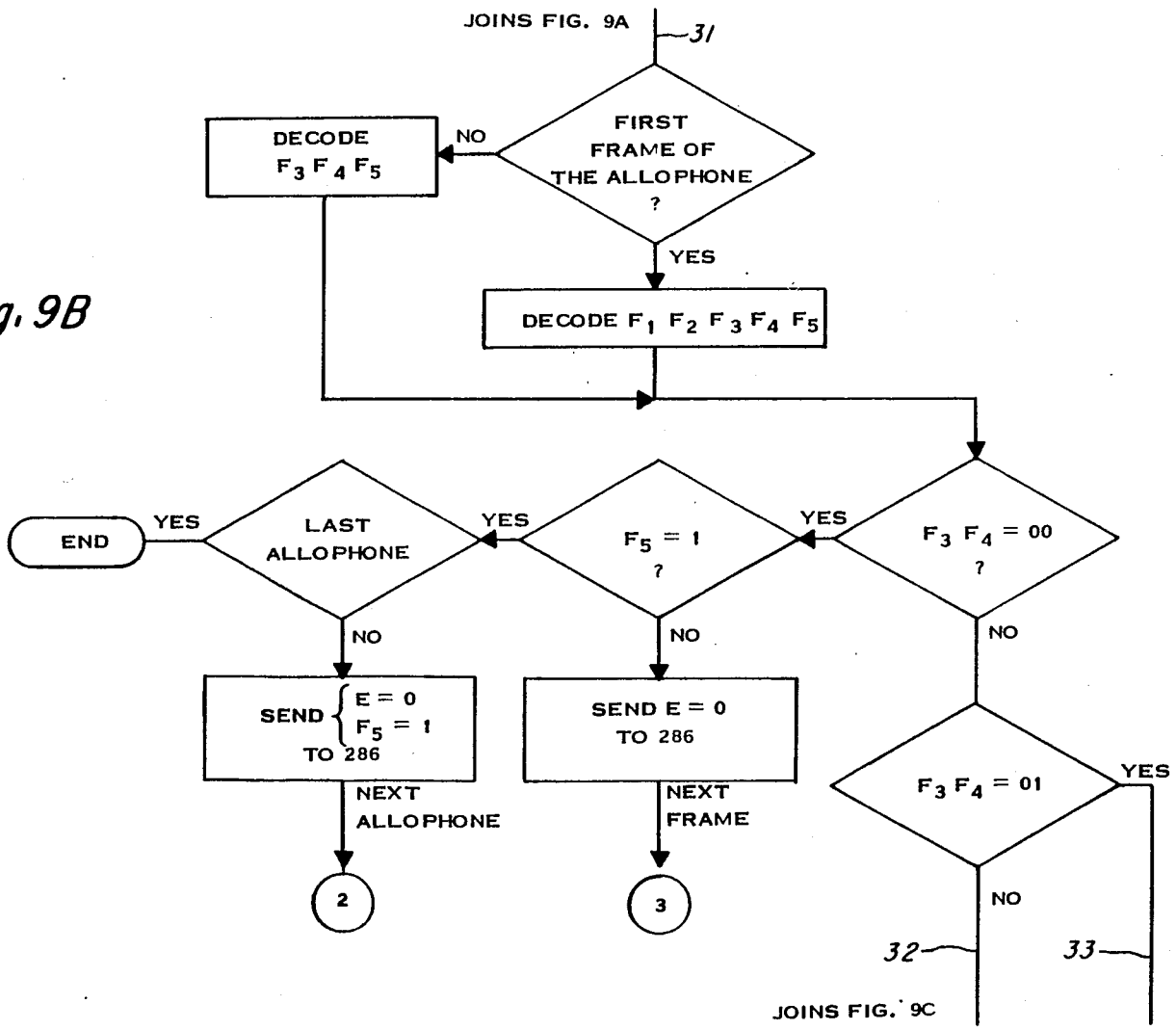
Figure 9C:
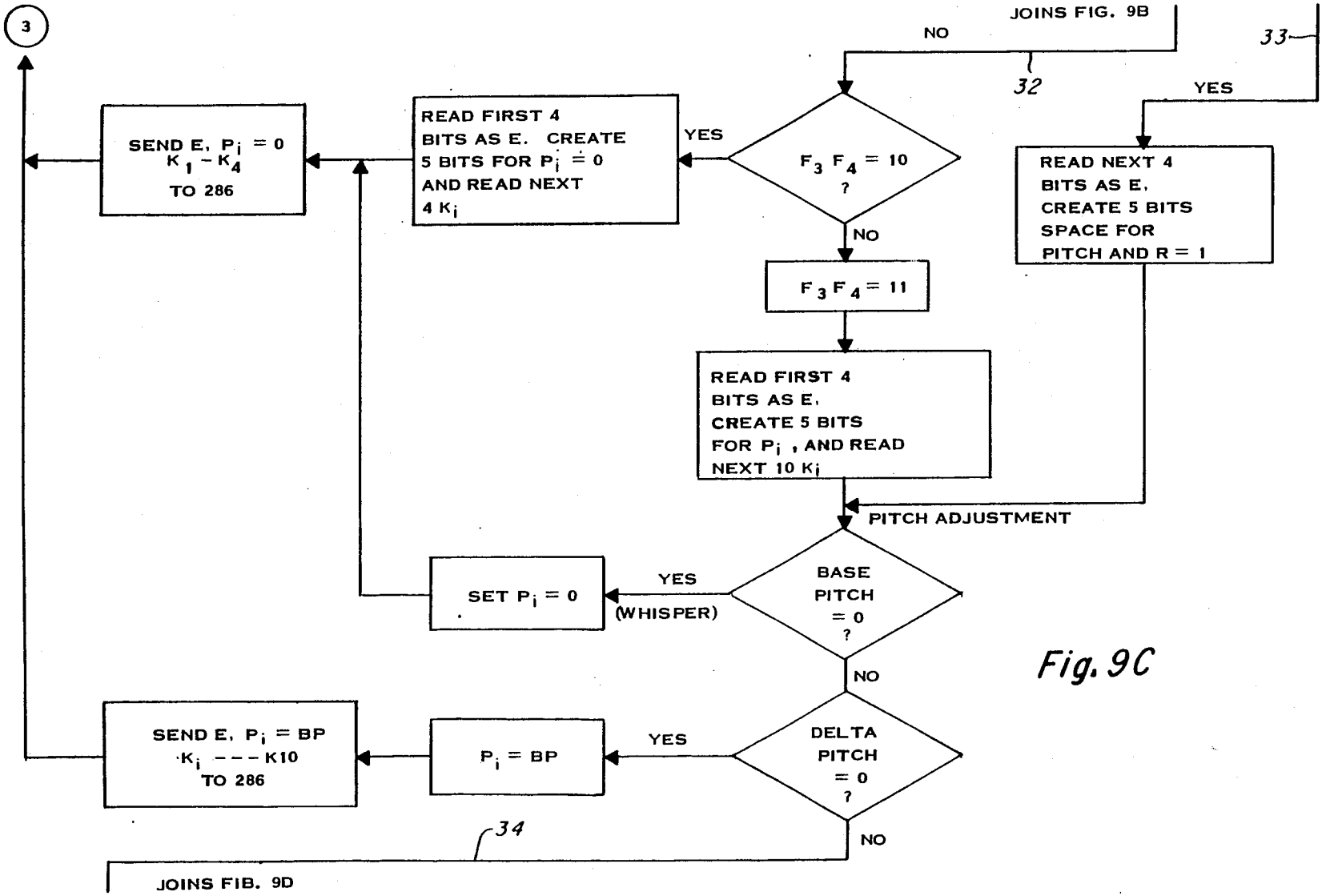

Turning to FIG. 9*b*, if it was determined that F3 F4=01, then on path 33 into FIG. 9*c*, the next four bits are read as energy, a five bit space is created for pitch and repeat (R)=1. At this point, if F3 F4=11 or if F3 F4=01, a pitch adjustment is to be made. The inquiry "base pitch=0?" is made. If the answer is "yes", then the speech is a whisper and pitch is set to 0. At that point, energy and pitch=0 and K1 to K4 are sent to the 286 synthesizer 14. The next frame is brought in as indicated on FIG. 9*a*.

If the base pitch≠0, then a decision is made as to whether the delta pitch=0. If the answer is "yes", then the pitch is made equal to the base pitch. The energy, and pitch equal to the monotone base pitch, and the parameters K1–K10 are sent to the 286 synthesizer 14 and the next frame is brought in.

Figure 9D:
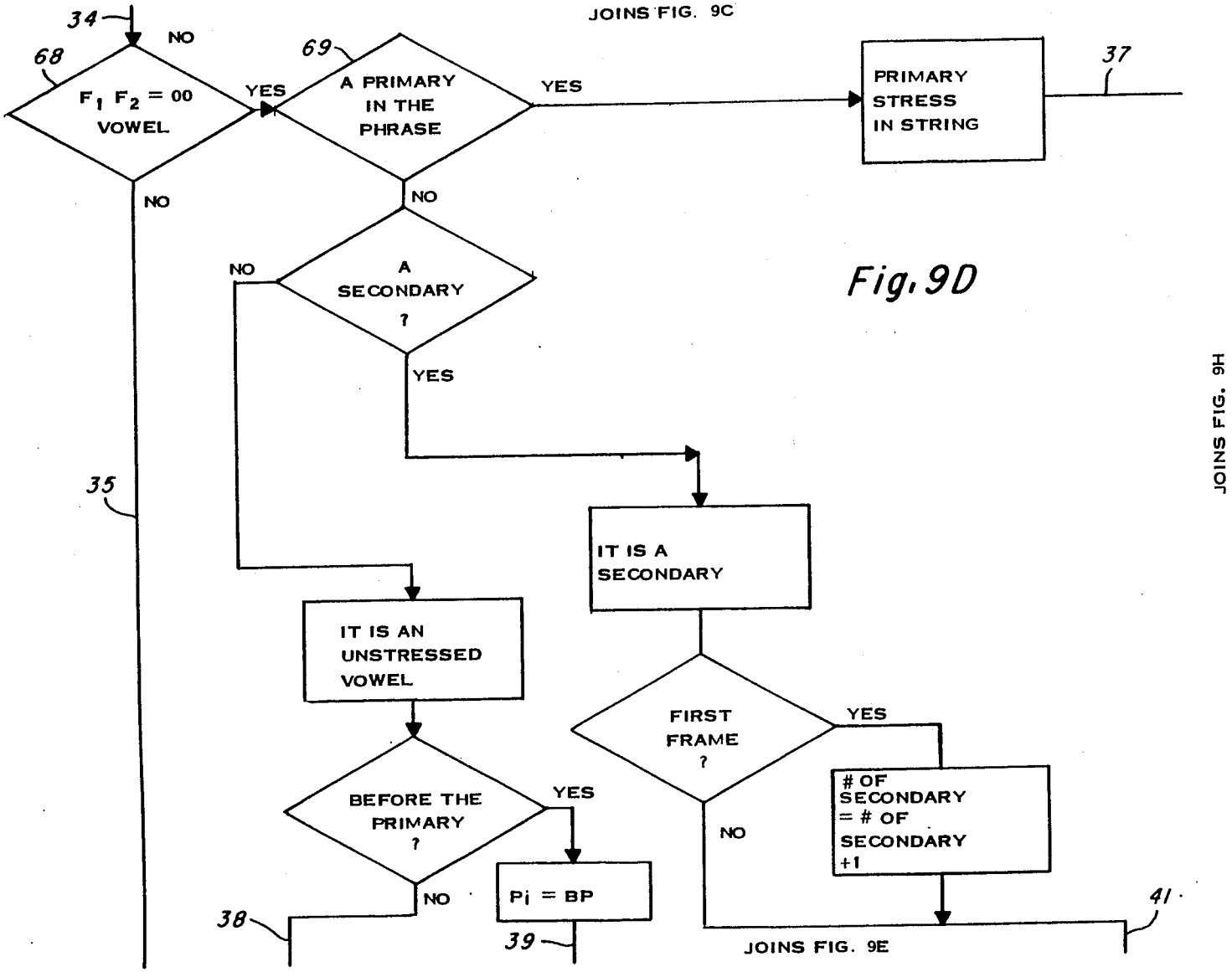
Figure 9E:
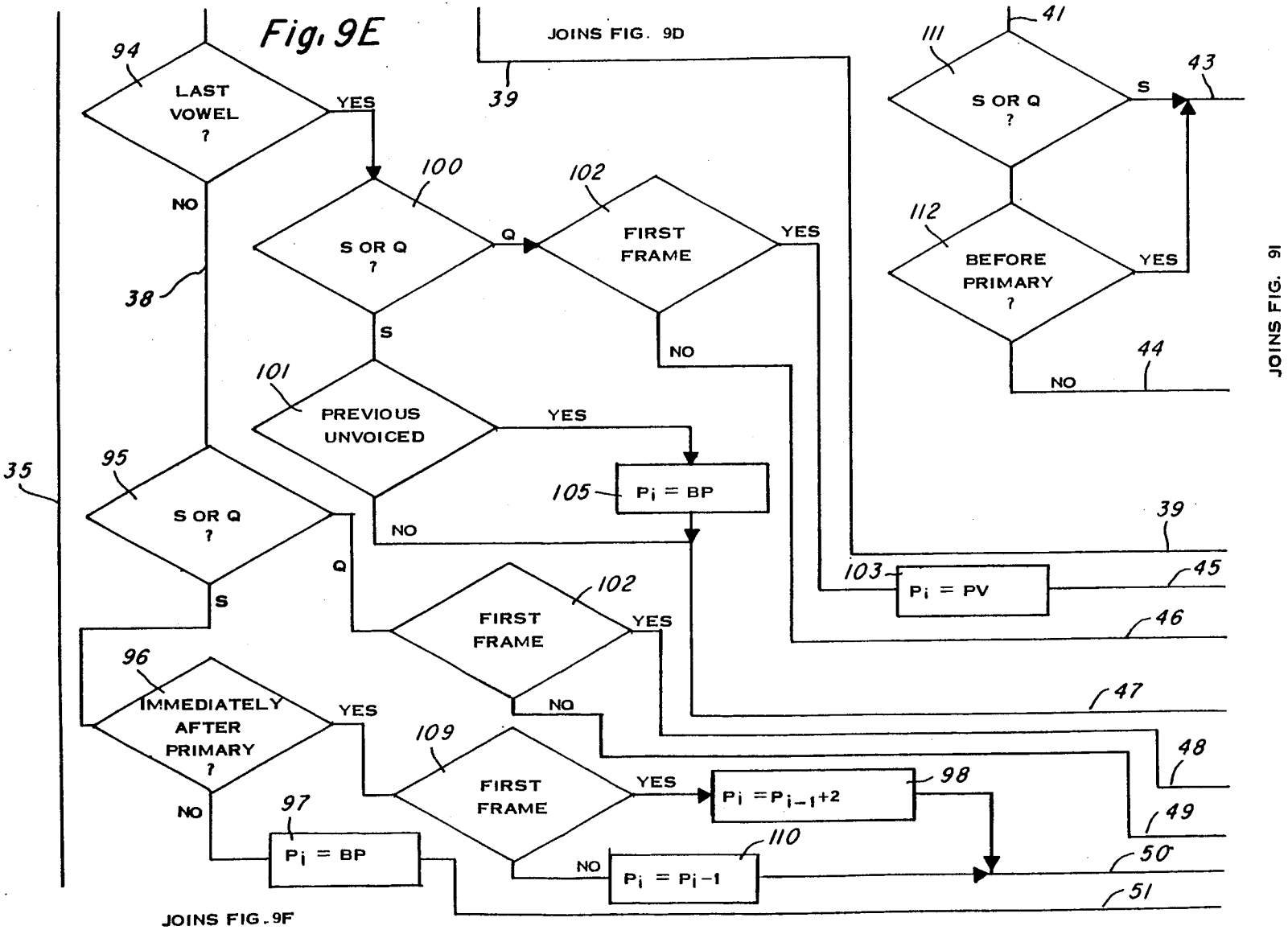
Figure 9F:
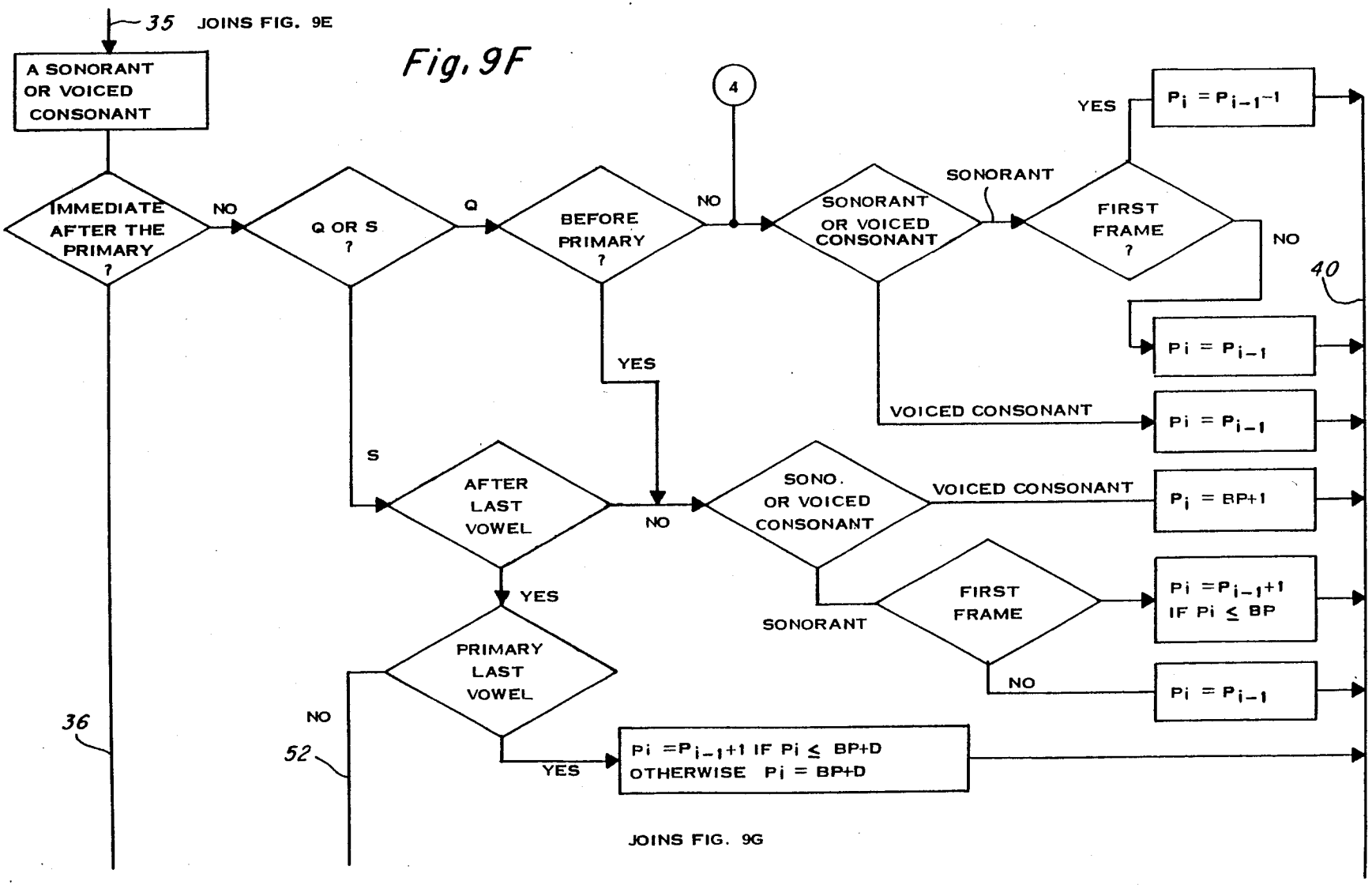
Figure 9G:
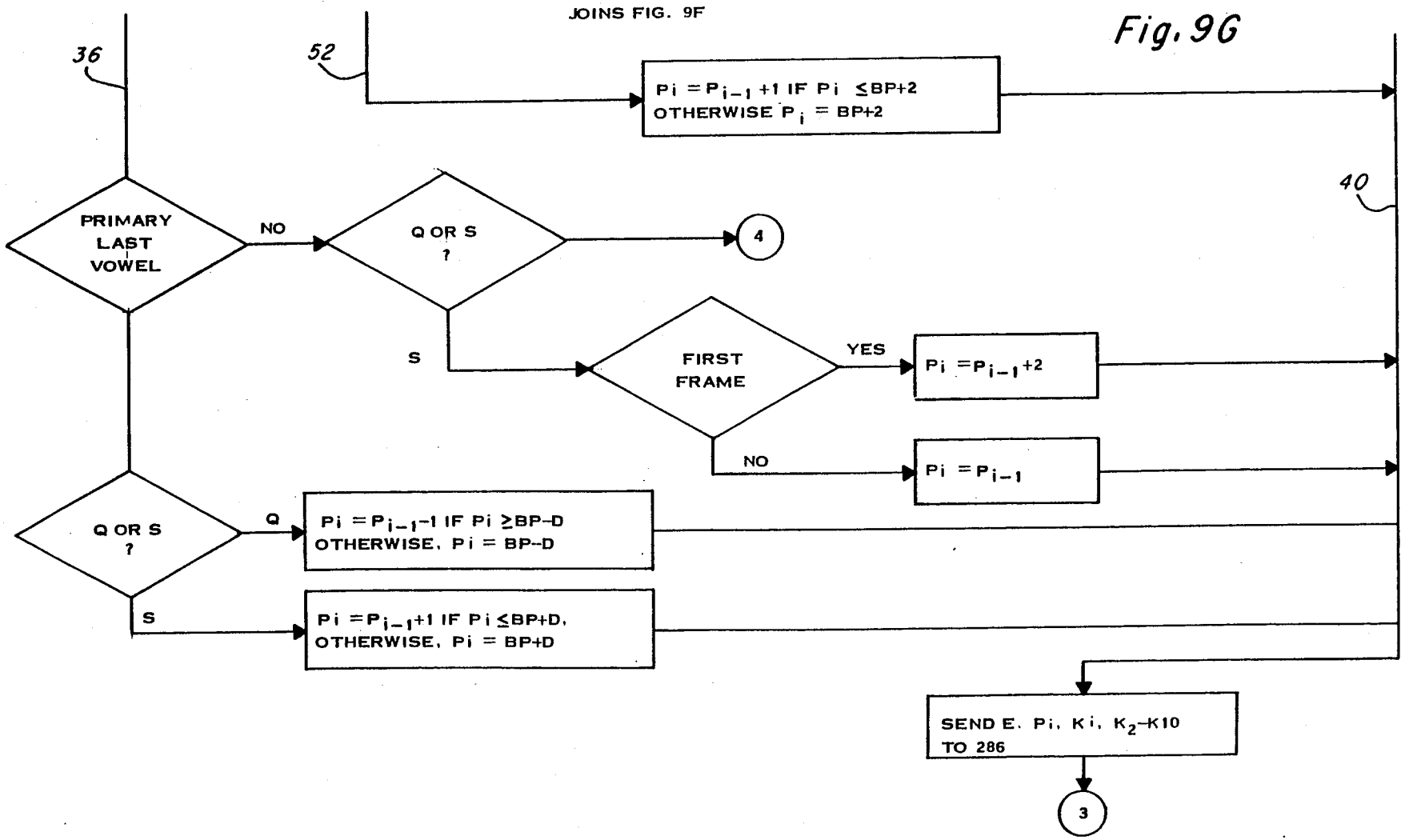

If the delta pitch≠0, then on path 34 into FIG. 9*d*, it is determined whether F1 F2=00, indicating a vowel. If the answer is "yes", then the question "a primary in the phrase " is asked. If the answer is "no" it is asked whether there is a secondary in the phrase. If the answer is "no", then the vowel is unstressed and the question is asked "is this vowel before the primary stress". If the answer is "no", then on path 38 to FIG. 9*e*, the decision is made as to whether this is the last vowel. If the answer is "no", then the decision is made as to whether it is a statement or a question type phrase. If the answer is that it is a statement, the decision is made to determine whether it is immediately after the primary stress. If the answer is "no", then the pitch is made equal to the base pitch and on path 51 to FIG. 9*i*, it is seen that path 40 returns to FIG. 9*g* where it is indicated that all parameters are sent to the 286 synthesizer 14 for reading and another frame is brought in. This particular path was chosen because of its simplicity of explanation. The multitude of remaining paths shown illustrate in great detail the selection of pitch at the required points.

Figure 9H:
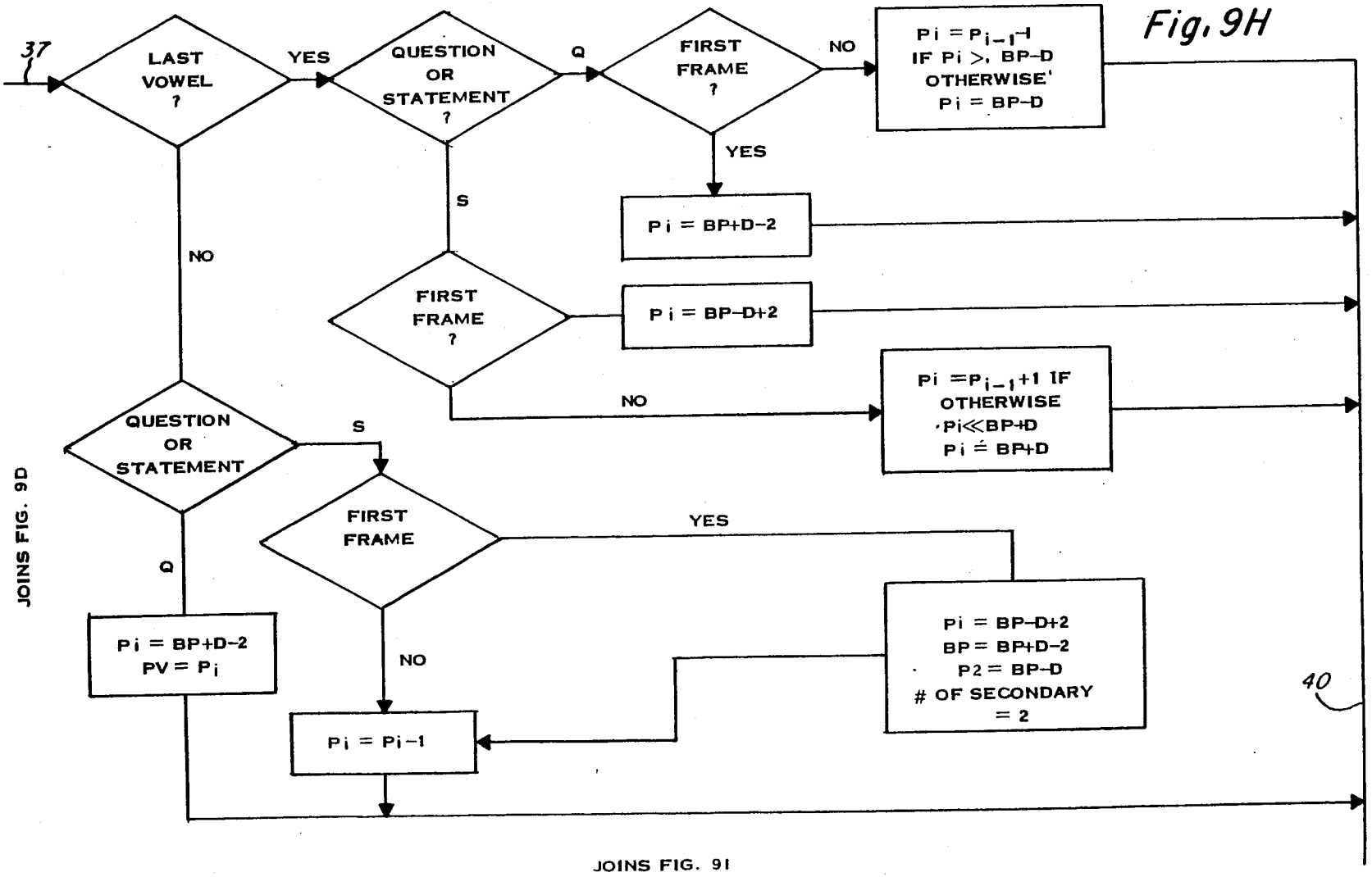
Figure 9I:
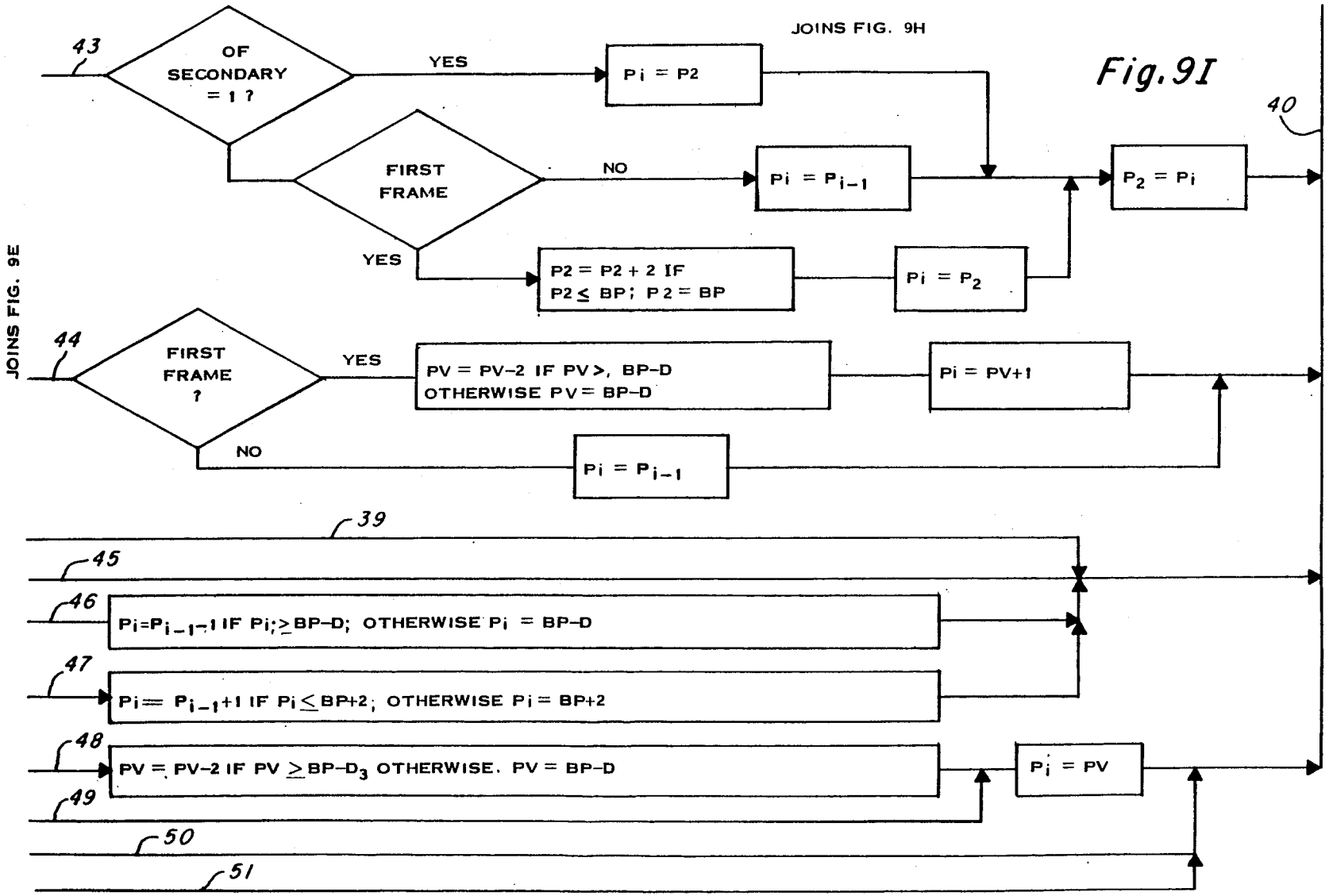

The assignment of descending or ascending base pitch is shown in FIG. 9*h*. Path 37 from FIG. 9*d* indicates that there is a primary stress in the particular string and if it is the last vowel, then it is determined whether the phrase is a question or statement. If it is a question, it is determined whether it is the first frame of the allophone. If the answer is "yes", then pitch is assigned as indicated equal to BP+D−2. If it is a statement, and it is the first frame, then pitch is assigned as BP−D+2.

MODE OF OPERATION

The operation of this invention is primarily shown in FIGS. 3*a*–3*f*, 8*a*, 8*b* and 9*a*–9*i*. In broad terms, however, the text-to-speech synthesis system accepts ASCII code, looks up the appropriate allophonic code in the allophone rules, and assigns stress and pitch. The allophonic code is then received through the 420 microprocessor 11 shown in FIG. 1. The code received is related to an address in the allophone library 12. The code is sent by the 420 microprocessor 11 to 356 stringer 13 where the address is read and the allophone is brought out when handled as indicated in FIGS. 9*a*–9*i*. The basic control by the 420 microprocessor 11 in causing the action by the 356 stringer 13 is shown in FIGS. 8*a* and 8*b*. The 286 synthesizer 14 receives the allophone parameters from the 356 stringer 13 and forms an analog signal representative of the allophone to the speaker 15 which then provides speech-like sound.

This inventive speech producing system, in its preferred embodiment, describes an LPC synthesizer on an integrated circuit chip with LPC parameter inputs provided through allophones read from the allophonic library. It is of course contemplated that other waveform encoding types of code inputs may be used as inputs to a speech synthesizer. Also, the specific implementation shown herein is not to be considered as limiting. For example, a single computer could be used for the functions of the microcomputer, the allophone library, and the stringer of this invention without departing from its scope. The breadth and scope of this invention is limited only by the appended claims.

What is claimed:

1. A test-to-speed synthesis system for converting printed data as represented by digital characters into audible synthesized speech, said system comprising:

allophone rule means having a plurality of allophonic code signals corresponding to the digital characters which are representative of the printed data, wherein the allophonic code signals are determinative of the respective allophone subset variants of each of the recognized phonemes in a given spoken language as modified by the speech environment in which the particular phoneme occurs;

allophone rules processor means having an input for receiving the digital characters representative of printed data and operably coupled to said allophone rule means for searching the allophone rule means to provide an allophonic code signal output corresponding to the digital characters received by sid allophone rules processor means from the allophonic code signals of said allophone rule means; and synthesized speech producing means operably coupled to said allophone rules processor means for receiving said allophonic code signal output therefrom to produce an audible synthesized speech-like sound in response to said allophonic code signal output from said allophone rules processor means.

2. The system of claim 1 wherein said allophone rule means comprises digital storage means in which said allophonic code signals are stored.

3. The system of claim 2 wherein said digital storage means comprises a read-only-memory.

4. The system of claim 3 wherein said allophone rules processor means comprises a rules microprocessor.

5. The system of claim 4 wherein said allophone rule means has a plurality of allophonic code signals comprising a plurality of allophone rules arranged in respective character sets as determined by the character and the neighboring characters on each side thereof stored in a common section of said read-only-memory for each of the digital characters representative of printed data that may be input to the system.

6. The system of claim 5 wherein said plurality of allophonic code signals comprising said plurality of allophone rules define units of speech representative of the digital character sets, each of which is assigned a particular allophonic code signal as determined by the character set.

7. The system of claim 6, wherein said allophone rules processor means is responsive to a digital character set received as an input thereto for searching a common section of said read-only-memory comprising said allopohone rule means to obtain a match between the digital character set and respective allophonic code signals stored in said read-only-memory for providing as an output the assigned allophonic code signal for the matched digital character set.

8. The system of claim 3 wherein said synthesized speech producing means comprises:

allophone library means in which digital signals representative of allophone-defining speech parameters identifying the respective allophone subset variants of each of the recognized pheonemes in a given spoken languaage as modified by the speech environment in which the particular phoneme occurs are stored, said allophone library means being operably coupled to said allophone rules processor means and being responsive to the allophonic code signal output therefrom for providing digital signals representative of the particular allophone-defining speech parameters corresponding to said allophonic code signal output;

means operably associated with said allophone library means for concatenating the digital signals, for designating stress and intonation patterns and for designating a pitch parameter for the allophone-defining speech parameters, wherein the allophone is defined by a plurality of speech data frames each of which comprises allophone-defining speech parameters and wherein a pitch parameter is designated for each speech data frame;

speech synthesizing means operable coupled to said digital signal-concatenating means for receiving the digital signals representative of allophone-defining speech parameters and providing analog signals representative of synthesized speech corresponding to the digital signals received thereby;

smoothing means operatively associated with said speech synthesizing means for selectively smoothing the transition between respective allophones as defined by pluralities of speech data frames; and audio output means operatively connected to the output of said speech synthesizing means for receiving said analog signals representative of syntheiszed speech therefrom to produce audible synthesized speech-like sounds having stress and intonation incorporated therein.

9. The system of claim 8 wherein said allophone library menas comprises a read-only-memory having a plurality of storage addresses respectively corresponding to allophonic code signals of said allophone rule means, the data contents at each of said storage addresses of said allophone library means including digital signals representative of allophone-defining speech parameters.

10. The system of claim 3, wherein said synthesized speech producing means comprises:

allophone library means in which digital signals representative of allophone-defining speech parameters identifying the respective allophone subset variants of each of the recognized phonemes in a given spoken language as modified by the speech environment in which the particular phoneme occurs are stored, said allophone library means being operably coupled to said allophone rules processor means and being responsive to said allophonic code signal output therefrom for providing digital signals representative of allophone-defining speech parameters corresponding to said allophonic code signal output;

means operably coupled to said allophone library means for concatenating said digital signals provided thereby and for designating stress and intonation patterns with respect thereto;

semiconductor integrated circuit speech synthesizing means operatively associated with said concatenating means for receiving said digital signals representative of allophonedefining speech parameters and providing analog signals representative of synthesized speech corresponding to said digital signals; and audio output means coupled to the output of said semiconducotor intergrated circuit speech synthesizing means for receiving said analog signals representative of synthesized speech therefrom to produce audible synthesized speech-like sounds with stress and intonation incorporated therein.

11. The system of claim 10 wherein said allophone library means comprises a read-only-memory having a plurality of storage addresses respectively corresponding to allophonic code signals of said allophone rule means, the data contents at each of said storage addresses of said allophone library means including digital signals representative of allophone-defining speech parameters.

12. The system of claim 10 wherein said semiconductor integrated circuit speech synthesizing means is a linear predictive coding speech synthesizer.

13. The system of claim 12 further comprising smoothing means operatively associated with said concatenating means for selectively smoothing the transition between the digital signals representative of allophone-defining speech parameters identifying adjacent allophones.

14. The system of claim 13 wherein said allophone library means comprises a read-only-memory having a plurality of storage addresses respectively corresponding to allophonic code signals of said alloiphone rule means, the data contents at each of said storage addresses of said allophone library means including digital signals representative of allophone-defining speech parameters.

15. The system of claim 13 wherein said concatenating means further includes means for designating a pitch parameter for the allohpone-defining speech parameters as represented by the digital signals from said allophone library means corresponding to said allophonic code signal output.

16. The system of claim 15, wherein the digital characters representative of printed data as recieved by the input of said allophone rules processor means are modified to include stress code data therein identifying portions of the digital character input corresponding to syllables in the printed data which are to be stressed, the allophonic code signal output from said allophone rules processor means reflecting the stress code data in the digital characters received thereby such that the digital signals provided by said allophone library means in response to said allophonic code output are representative of allophone-defining speech parameters including the syllable stress as identified by the stress code data, and said pitch parameter-designating means being responsive to said digital signals provided by said allophone library means for designating a base pitch parameter for the allophone-defining speech parameters as modified by the syllable stress included therein.

17. The system of claim 16 wherein the allophone is defined by a plurality of speed data frames each of which comprises allophone-defining speech parameters, and wherein a base pitch parameter is designated by said pitch parameter-designating means fo each speech data frame.

18. The system of claim 17 wherein the stress and intonation patterns designated by said concatenating means are dependent upon gradient pitch control of the stressed syllables preceding the primary stress of the phrase of printed data as represented by the digital characters having stress code data therein, and the gradient pitch control being provided by said pitch parameter-designating means.

19. The system of claim 18 wherein the base pitch comprises a descending gradient for a statement and an ascending gradient for a question.

20. The system of claim 19 wherein said pitch parameter-designating means includes means for designating a delta pitch parameter for limiting the amplitude of the primary or secondary stress.

21. The system of claim 20 wherein each frame comprises a signal indicating whether or not the frame is the end of the allophone.

22. The system of claim 21 wherein the smoothing means comprises means for selectively inserting an additional frame after the last frame in the allophone.

23. The system of claim 22 wherein the smoothing means further comprises means for identifying the current allophone and the subsequent allophone as voiced or unvoiced, or stop.

24. The system of claim 23 wherein the means for selectively inserting an additional frame is activated when no stop is present, and the current allophone and the subsequent allophone are both voiced or both unvoiced.

25. A method for producing audible synthesized speech from printed data as represented by digital characters, said method comprising:

storing a plurality of allophone rules corresponding to the digital characters which are representative of the printed data, wherein the allophone rules are determinative of the respective allophone subset variants of each of the recognized phonemes in a given spoken language as modified by the speech environment in which the particular phoneme occurs;

providing digital characters representative of the printed data so as to define respective digital character sets;

searching the allophone rules for a match to a digital character set;

providing an allophonic code signal corresponding to the matched digital character set;

storing digital signals representative of allophone-defining speech parameters identifying the respective allophone subset variants of each of the recognized phonemes in a given spoken language as modified by the speech environment in which the particular phoneme occcurs;

reading out the particular digital signals corresponding to the allophonic code signal;

concatenating the read out digital signals;

providing digitally coded pitch parameters and intonation to the concatenated digital signals;

transmitting the concatenated digital signals to a speech synthesizer;

generating analog signals representative of synthesized speech by the speech synthesizer corresponding to the concatenated digital signals received thereby; and directing the analog signals representative of synthesized speech to an audio output means to produce audible synthesized speech-like sounds.

26. A method as set forth in claim 25, further including modifying the digital characters representative of the printed data prior to the search of the allophone rules to include stress code data therein identifying portions of the digital characters corresponding to syllables in the printed data which are to be stressed such that the allophonic code signal corresponding to the matched digital character set will reflect the stress code data therein.

27. The method of claim 26 further including selectively smoothing the transition between the digital signals representative of allophone-defining speech parameters identifying adjacent allophones after the concatenation of the digital signals.

* * * * *